US008264508B2

(12) United States Patent
Sugiyama

(10) Patent No.: US 8,264,508 B2
(45) Date of Patent: Sep. 11, 2012

(54) IMAGE FORMING APPARATUS AND METHOD FOR CONTROLLING THE SAME

(75) Inventor: Norikazu Sugiyama, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/239,095

(22) Filed: Sep. 21, 2011

(65) Prior Publication Data

US 2012/0008966 A1 Jan. 12, 2012

Related U.S. Application Data

(63) Continuation of application No. 12/044,349, filed on Mar. 7, 2008, now Pat. No. 8,044,986.

(30) Foreign Application Priority Data

Mar. 12, 2007 (JP) ..... 2007-062482
Feb. 5, 2008 (JP) ..... 2008-025738

(51) Int. Cl.
*G03G 15/01* (2006.01)
*B41J 2/455* (2006.01)

(52) U.S. Cl. ..... 347/116; 347/118; 347/234; 399/301

(58) Field of Classification Search ..... 399/39, 399/301; 347/116
See application file for complete search history.

(56) References Cited

U.S. PATENT DOCUMENTS

| | | | | |
|---|---|---|---|---|
| 6,421,076 | B1 * | 7/2002 | Asaya | 347/234 |
| 6,603,495 | B2 * | 8/2003 | Hayakawa | 347/116 |
| 6,711,364 | B2 * | 3/2004 | Shinohara | 399/49 |
| 6,873,346 | B2 * | 3/2005 | Bannai | 347/116 |
| 7,239,833 | B2 * | 7/2007 | Tomita et al. | 399/299 |
| 7,415,231 | B2 * | 8/2008 | Maeda | 399/301 |
| 7,576,764 | B2 * | 8/2009 | Shinohara | 347/235 |
| 7,647,015 | B2 * | 1/2010 | Kubota et al. | 399/301 |
| 2004/0239747 | A1 * | 12/2004 | Maeda | 347/116 |
| 2005/0047834 | A1 * | 3/2005 | Tomita et al. | 399/301 |

* cited by examiner

*Primary Examiner* — Omar Rojas
(74) *Attorney, Agent, or Firm* — Canon USA Inc. IP Division

(57) ABSTRACT

An image of a color misregistration detection pattern is formed, and the amount of color misregistration is detected by reading of the pattern image. The amount of color misregistration detected by a detecting unit and the delay time from the time when image data is requested to the time when the image data is output are stored. The color misregistration is corrected based on the stored delay time and amount of color misregistration.

6 Claims, 22 Drawing Sheets

Cnt: COUNTER
T0: DETERMINED COUNT (T0>0)

Cnt: COUNTER
T0: PREDETERMINED COUNT 1 (T0 > 0)
T1: PREDETERMINED COUNT 2 (T1 > 0)
Td: TRANSMISSION DELAY TIME (Td > 0)

IMAGE FORMING APPARATUS AND METHOD FOR CONTROLLING THE SAME

CROSS REFERENCE OF RELATED APPLICATIONS

This application is a continuation of U.S. patent application Ser. No. 12/044,349 filed Mar. 7, 2008 which claims the benefit of Japanese Application No. 2007-062482 filed Mar. 12, 2007 and Japanese Application No. 2008-025738 filed Feb. 5, 2008, all of which are hereby incorporated by reference herein in their entirety.

BACKGROUND OF THE INVENTION

1. Field of the Invention

The present invention relates to a technique for reducing color misregistration for use in an image forming apparatus.

2. Description of the Related Art

The speed at which an image is formed in recent color image forming apparatuses is becoming increasingly higher. With this, color misregistration (a problem in which images of different colors that should be formed in the same position are formed in different positions on a recording material) resulting from a plurality of factors may occur. A main factor is the accuracy with which an optical unit arranged for each color is mounted.

This problem is present especially in a tandem color image forming apparatus, which includes the same numbers of developing units and photosensitive drums as coloring materials and sequentially transfers images for different colors onto an intermediate transfer member or a recording medium.

FIGS. 19A and 19B are illustrations for describing an example of color misregistration in a main scanning direction. An image position 201 is an image position at which an image should be formed, and image positions 202*a* and 202*b* are positions of an image suffering color misregistration. In FIGS. 19A and 19B, for the sake of illustration, the gap between two lines extends in the direction of conveyance. FIG. 19A illustrates an error of a position at which image formation starts in the direction in which sheets are conveyed. This can be corrected in the direction of the arrow by, for example, adjustment of the time of starting image formation for each color from detection of the leading end of the sheet. FIG. 19B illustrates an error of a position at which image formation starts in the main scanning direction. When a laser scanner is used as an optical unit, this can be corrected in the direction of the arrow by, for example, adjustment of the time of starting image formation from a position where a beam is detected.

There is a technique for correcting such color misregistration by generating a color misregistration detection pattern for each color on an intermediate transfer member, detecting the pattern by using an optical sensor disposed downstream of the intermediate transfer member, determining the amount of color misregistration, and correcting the color misregistration (see, for example, Japanese Patent Laid-Open No. 10-260567).

However, the known technique cannot be applied to an apparatus that is operable in modes for different scanning speeds and that can perform scanning for a reference color (first color) and scanning for another color (second color) in different scanning directions, so the color misregistration problem still remains.

SUMMARY OF THE INVENTION

Embodiments of the present invention are provided to overcome the above-described drawbacks of the related technology. Specifically, the present invention provides a technique for reducing color misregistration occurring during color image formation under a wider range of conditions.

According to an aspect of the present invention, a color image forming apparatus includes a plurality of laser beam generating units corresponding to a plurality of colors, a plurality of photosensitive members, a plurality of developing units, and a detecting unit. Each of the laser beam generating units is configured to emit a laser beam based on image data output from an image data generating unit. The plurality of photosensitive members are configured to be exposed by optical scanning performed by the plurality of laser beam generating units and have respective electrostatic latent images formed thereon. The plurality of developing units are configured to develop the respective electrostatic latent images formed on the plurality of photosensitive members. The detecting unit is configured to read an image of a color misregistration detection pattern for each color formed by irradiation with a laser beam from the plurality of laser beam generating units and detect an amount of color misregistration, the amount of color misregistration being a relative positional displacement between the colors. The color image forming apparatus is operable in a plurality of operation modes including a first operation mode in which an optical scanning speed is a first scanning speed and a second operation mode in which the optical scanning speed is a second scanning speed different from the first scanning speed. The plurality of laser beam generating units perform scanning in a first scanning direction on a first color and scanning in a second scanning direction on a second color, the first scanning direction being different from the second scanning direction. A delay time from detection of a synchronization signal for synchronizing image writing timing in a main scanning direction in image formation to reception of the image data output from the image data generating unit in response to the detected synchronization signal occurs by the plurality of laser beam generating units. In the first operation mode, at least one of the plurality of laser beam generating units emits a laser beam with image writing timing that enables influence of the delay time to be reduced and forms the image of the color misregistration detection pattern. The detecting unit detects the amount of color misregistration, which is the relative positional displacement between the colors, based on reading of the image of the color misregistration detection pattern performed by irradiation with the laser beam with the image writing timing that enables the delay time to be reduced. In the second operation mode, the image writing timing that enables the delay time to be reduced is revised based on the amount of color misregistration detected by the detecting unit, and at least one of the plurality of laser beam generating units emits a laser beam with the revised image writing timing.

According to another aspect of the present invention, a color image forming apparatus includes a plurality of laser beam generating units corresponding to a plurality of colors, a plurality of photosensitive members, a plurality of developing units, and a detecting unit. Each of the laser beam generating units is configured to emit a laser beam based on image data output from an image data generating unit. The plurality of photosensitive members is configured to be exposed by optical scanning performed by the plurality of laser beam generating units and have respective electrostatic latent images formed thereon. The plurality of developing units is configured to develop the respective electrostatic latent images formed on the plurality of photosensitive members. The detecting unit is configured to read an image of a color misregistration detection pattern for each color formed by irradiation with a laser beam from the plurality of laser beam generating units and detect an amount of color misregistration, the amount of color misregistration being a relative positional displacement between the colors. The color image forming apparatus is operable in a plurality of operation modes including a first operation mode in which an optical scanning speed is a first scanning speed and a second operation mode in which the optical scanning speed is a second scanning speed lower than the first scanning speed. The plurality of laser beam generating units perform scanning in a first scanning direction on a first color and scanning in a second scanning direction on a second color, the first scanning direction being different from the second scanning direction. A delay time from detection of a synchronization signal for synchronizing image writing timing in a main scanning direction in image formation to reception of the image data output from the image data generating unit in response to the detected synchronization signal by the plurality of laser beam generating units occurs. To correct color misregistration using the same amount of correction of color misregistration based on the amount of color misregistration detected by the detecting unit in both the first operation mode and the second operation mode, at least one of the plurality of laser beam generating units emits a laser beam with image writing timing that enables a difference between delay color misregistration in the first operation mode and delay color misregistration in the second operation mode to be reduced, the difference being defined by an image writing position corresponding to the length of the delay time in scanning performed in the first scanning direction and an image writing position corresponding to the length of the delay time in scanning performed in the second scanning direction.

Further features of the present invention will become apparent from the following description of exemplary embodiments with reference to the attached drawings.

DESCRIPTION OF THE EMBODIMENTS

Figure 1:
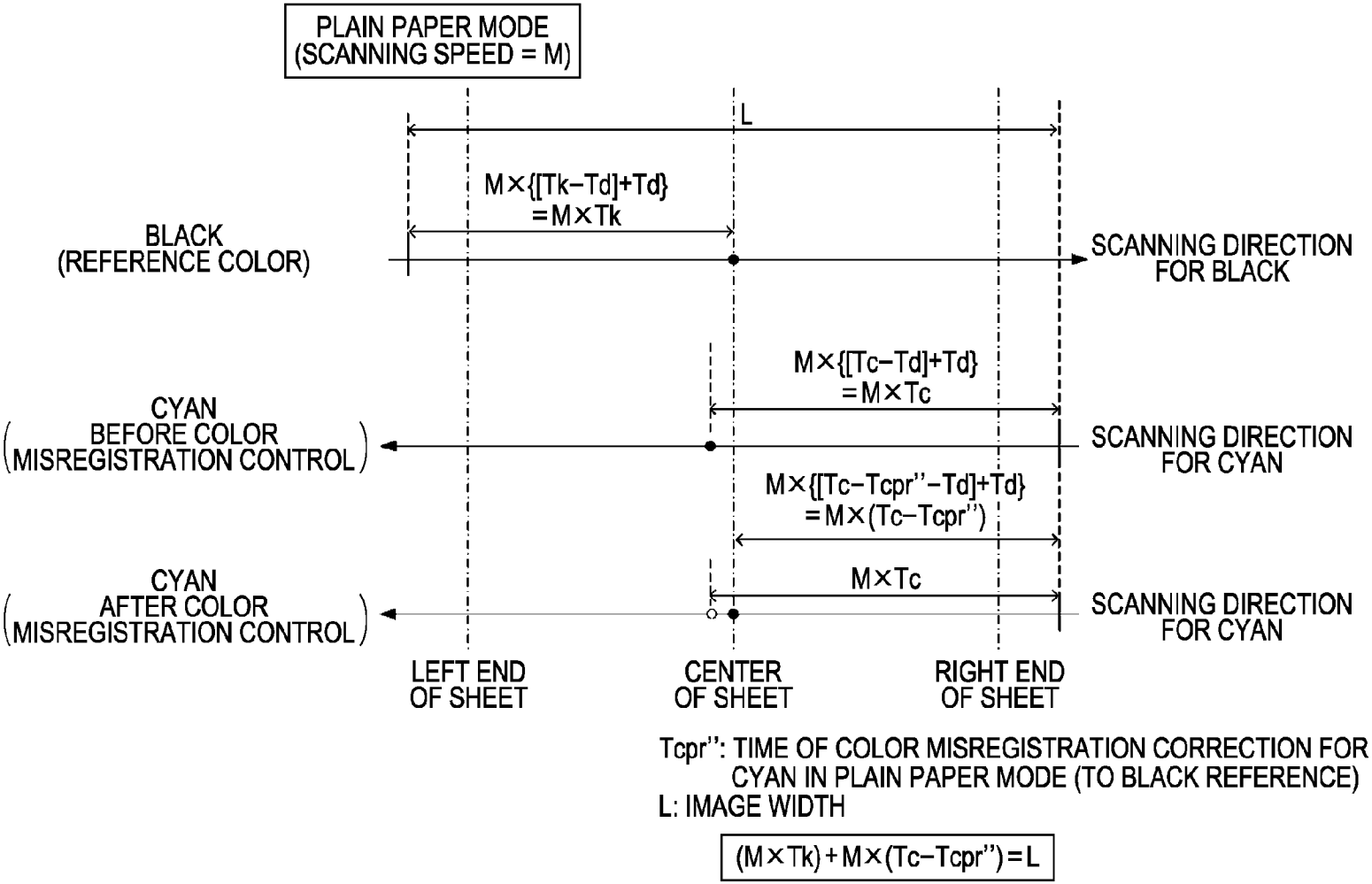
FIG. 1 illustrates correction of color misregistration in a plain-paper mode when the scanning direction for a reference color and the scanning direction for another color are different according to a first embodiment of the present invention.

Exemplary embodiments of the present invention are described below with reference to the accompany drawings, in which like reference characters designate the same or similar parts throughout the figures thereof. Components described in the embodiments are merely for illustrative purposes and are not intended to limit the scope of the present invention.

First Embodiment

An image forming apparatus according to a first embodiment of the present invention will be described below. The image forming apparatus according to the present embodiment is a color printer that can change a scan direction of a laser beam in the main scanning direction and can also change an optical scanning speed in response to a condition (mode). The printer corrects color misregistration on the basis of the amount of delay from the input of a beam detection signal from a laser beam generating unit to, through the generation of image data, the input of the image data into the laser beam generating unit. Specifically, in response to this amount of delay, the time when image data is generated is controlled.

Apparatus Configuration

Figure 2A:
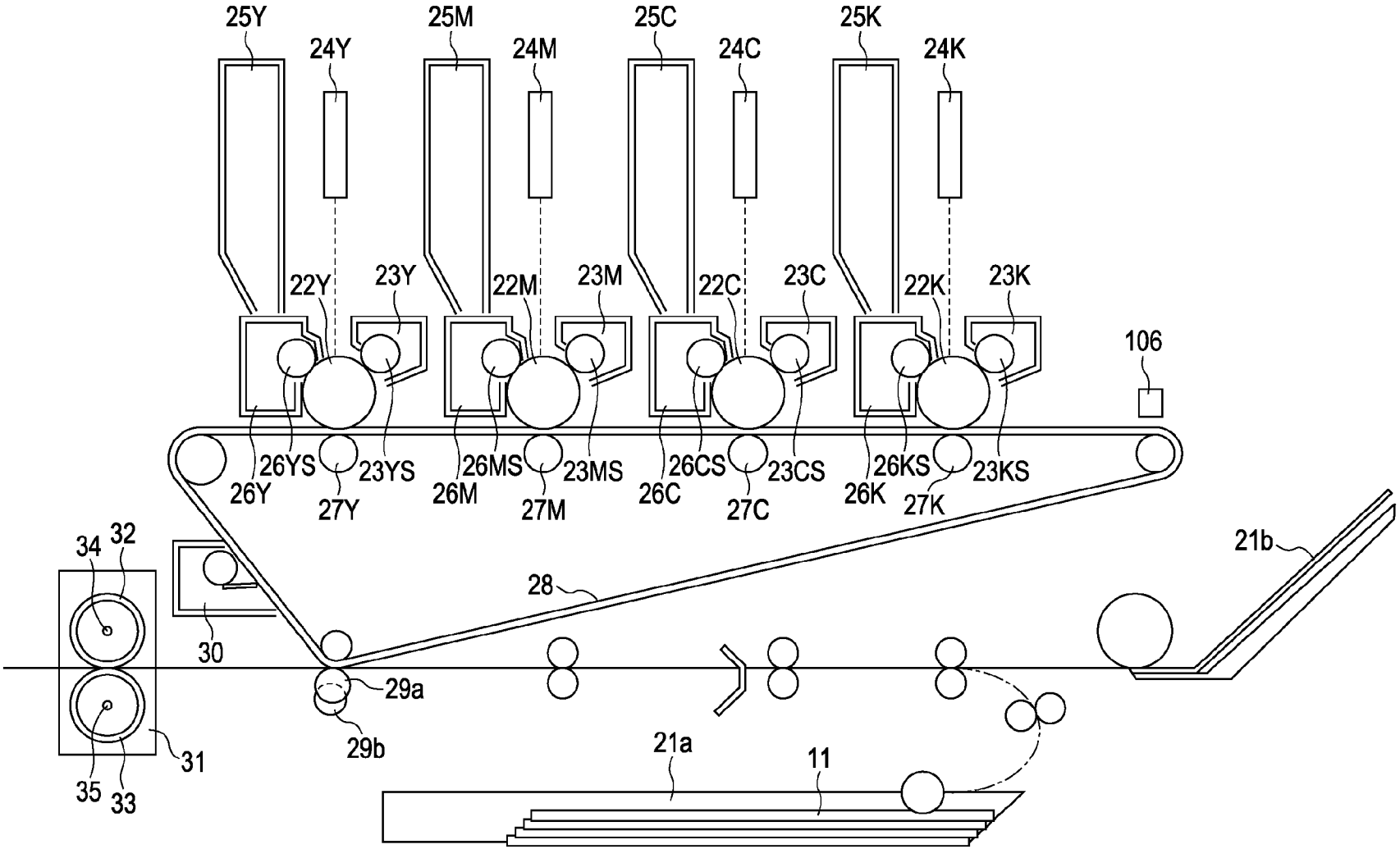
FIG. 2A is a cross-sectional view of an electrophotographic color printer according to the first embodiment.

FIG. 2A is a cross-sectional view of a tandem color printer that uses an intermediate transfer member 28. The tandem color printer is an example of an electrophotographic color image forming apparatus. The printer includes image forming units corresponding to a plurality of colors (four colors), e.g., yellow (Y), magenta (M), cyan (C), and black (Bk). An operation performed by the image forming units in an electrophotographic color printer is described below with reference to FIG. 2A. Recording media 11 are supported on paper feed cassettes 21*a* and 21*b*. Photosensitive drums 22Y, 22M, 22C, and 22K serve as an image bearing unit configured to form an electrostatic latent image (Y, M, C, and K indicate correspondence to Y, M, C, and Bk, respectively). Injection chargers 23Y, 23M, 23C, and 23K charge the photosensitive drums 22Y, 22M, 22C, and 22K, respectively. Laser scanners 24Y, 24M, 24C, and 24K form an electrostatic latent image for a corresponding color. Toner containers 25Y, 25M, 25C, and 25K feed toner for a corresponding color to developing devices 26Y, 26M, 26C, and 26K, respectively. Each of the developing devices 26Y, 26M, 26C, and 26K makes the electrostatic latent image visible as a toner image. The intermediate transfer member 28 bears the toner image. Primary transfer rollers 27Y, 27M, 27C, and 27K transfer the respective toner images onto the intermediate transfer member 28. A secondary transfer roller 29 transfers the toner image on the intermediate transfer member 28 onto a recording medium 11. A cleaning unit 30 cleans toner remaining on the intermediate transfer member 28. A fixing device 31 fuses and fixes the toner image on the recording medium 11. A fixing roller 32 and a pressure roller 33 configured to press the recording medium 11 into contact with the fixing roller 32 are heated by heaters 34 and 35. A color-misregistration detecting sensor 106 will be described below with reference to FIG. 3.

A laser beam generating unit 1001 (corresponding to the laser scanners 24Y, 24M, 24C, and 24K, which will be described below) emits exposure light in accordance with exposure time processed by a data control unit 1002. The time of emitting the exposure light is referred to as image writing timing. The time of exposure and the time of forming an electrostatic latent image are substantially the same, so the formation of an electrostatic latent image is sometimes referred to as image writing. In response to the exposure light (laser beam), an electrostatic latent image is formed on the photosensitive drums. The electrostatic latent image is developed, and toner images each corresponding to a single color are formed. The toner images are superposed on the intermediate transfer member 28, and thus, a multicolored toner image is formed. Thereafter, the multicolored toner image is transferred onto the recording medium 11. Then, the multicolored toner image on the recording medium 11 is fixed. The laser beam generating unit 1001 and the data control unit 1002 will be described below with reference to FIG. 5. In FIG. 2A, the main scanning direction in which the laser scanners 24Y, 24M, 24C, and 24K scan the respective photosensitive drums with the exposure light beams for a reference color for correction control of color misregistration is opposite to that for another color. The details of the correction control of color misregistration will be described below.

A charging portion serving as a charging unit includes the four injection chargers 23Y, 23M, 23C, and 23K configured to charge the photosensitive drums 22Y, 22M, 22C, and 22K, respectively, and provided for stations for yellow, magenta, cyan, and black, respectively. The injection chargers 23Y, 23M, 23C, and 23K include charging rollers 23YS, 23MS, 23CS, and 23KS, respectively.

The photosensitive drums 22Y, 22M, 22C, and 22K are made of an aluminum cylinder having outer areas to which an organic photoconductive layer is applied and are rotated by receiving a driving force of a driving motor (not shown). The driving motor rotates the photosensitive drums 22Y, 22M, 22C, and 22K counterclockwise in accordance with an image forming operation.

An exposing portion serving as an exposing unit irradiates the photosensitive drums 22Y, 22M, 22C, and 22K with exposure light from the laser scanners 24Y, 24M, 24C, and 24K and selectively exposes the surface of each of the photosensitive drums 22Y, 22M, 22C, and 22K, and an electrostatic latent image is formed. As also described above, exposing a photosensitive drum or forming an electrostatic latent image is referred to as performing image writing.

A developing portion serving as a developing unit includes the four developing devices 26Y, 26M, 26C, and 26K configured to develop images of yellow, magenta, cyan, and black, respectively, and provided for the respective stations to make the respective electrostatic latent images visible. The developing devices 26Y, 26M, 26C, and 26K include developing members 26YS, 26MS, 26CS, and 26KS, respectively. The developing devices and members 26 are detachable.

A transferring portion serving as a transferring unit rotates the intermediate transfer member 28 clockwise to transfer single-color toner images from the photosensitive drums 22Y, 22M, 22C, and 22K to the intermediate transfer member 28. The single-color toner images are transferred to the intermediate transfer member 28 by the rotation of the photosensitive drums 22Y, 22M, 22C, and 22K and the primary transfer rollers 27Y, 27M, 27C, and 27K, which face the photosensitive drums 22Y, 22M, 22C, and 22K, respectively. By application of an appropriate bias voltage to the primary transfer rollers 27Y, 27M, 27C, and 27K and use of difference between the rotation speed of the photosensitive drums 22Y, 22M, 22C, and 22K and the rotation speed of the intermediate transfer member 28, the single-color toner images are efficiently transferred to the intermediate transfer member 28. This is called a primary transfer.

In addition, the transfer portion serving as the transfer unit superposes the single-color toner images on the intermediate transfer member 28 on a station-by-station basis and transports a resulting multicolored toner image to the secondary transfer roller 29 with the rotation of the intermediate transfer member 28. The recording medium 11 is transported from the paper feed cassette 21*a* to the secondary transfer roller 29 while being nipped, and the multicolored toner image on the intermediate transfer member 28 is transferred onto the recording medium 11. The toner image is electrostatically transferred by application of an appropriate bias voltage to the secondary transfer roller 29. This is called a secondary transfer. While transferring the multicolored toner image onto the recording medium 11, the secondary transfer roller 29 is in contact with the recording medium 11 at a position 29*a*. After print processing, the secondary transfer roller 29 is separated to a position 29*b*. The recording medium 11 can be supported on the paper feed cassette 21*b*. In this case, the recording medium 11 is transported from the paper feed cassette 21*b* to the secondary transfer roller 29 while being nipped.

A fixing portion serving as a fixing unit includes the fixing roller 32 configured to heat the recording medium 11 and the pressure roller 33 configured to press the recording medium 11 into contact with the fixing roller 32 to fuse and fix the multicolored toner image transferred to the recording medium 11. Each of the fixing roller 32 and the pressure roller 33 is hollow. The heater 34 is incorporated in the fixing roller 32, and the heater 35 is incorporated in the pressure roller 33. The fixing device 31 transports the recording medium 11 bearing the multicolored toner image using the fixing roller 32 and the pressure roller 33, applies heat and pressure to the recording medium 11, and fixes the toner on the recording medium 11.

The recording medium 11 having the fixed toner is then ejected to a paper output tray (not shown) via an output roller (not shown). In this way, the image forming operation is completed.

The cleaning unit 30 is configured to remove toner remaining on the intermediate transfer member 28. Waste toner that remains after a multicolored toner image of four colors formed on the intermediate transfer member 28 is transferred to the recording medium 11 is accumulated in a cleaning container (not shown).

Figure 2B:
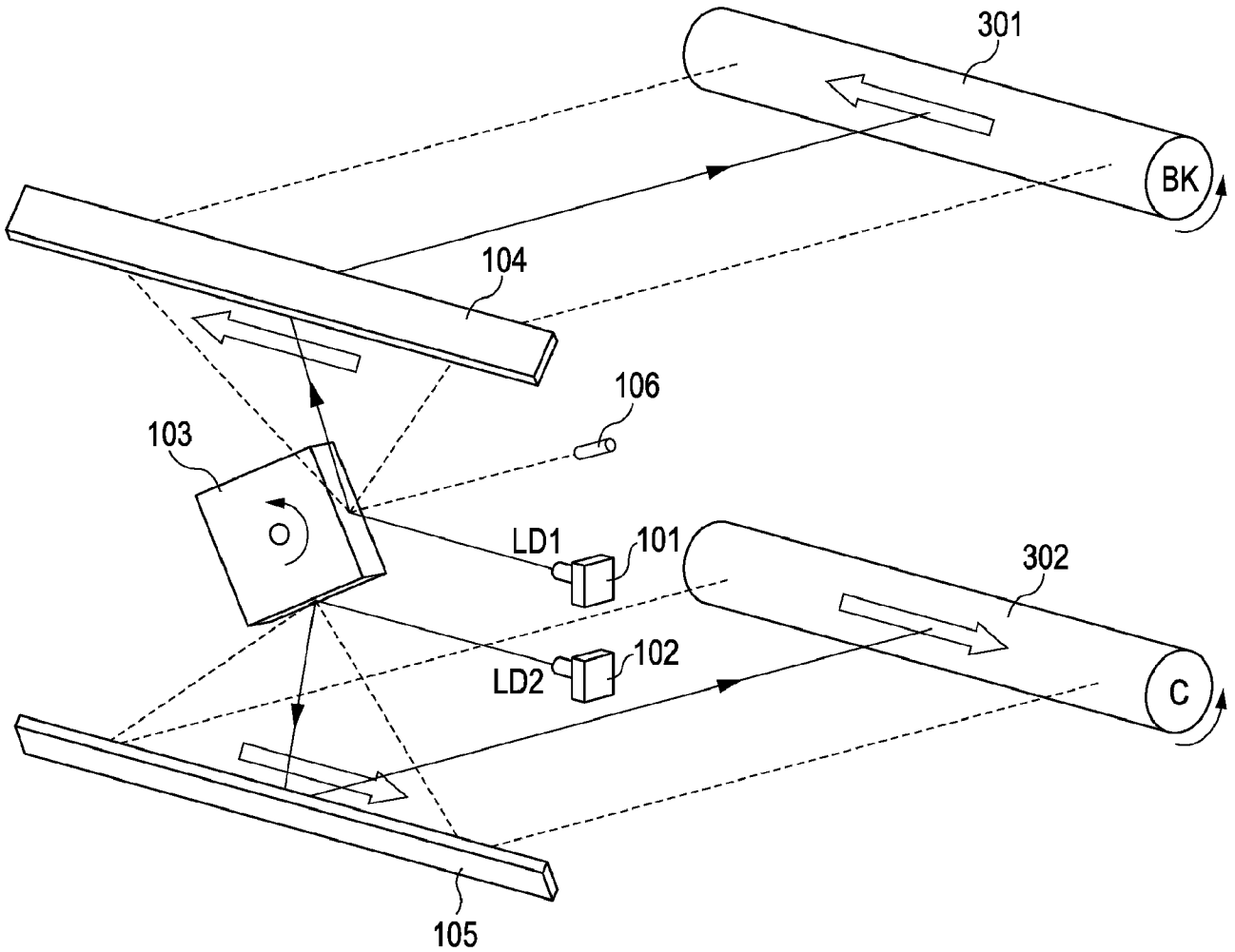
FIG. 2B is a cross-sectional view of another electrophotographic color printer according to the first embodiment.

FIG. 2B illustrates the relationship between the laser scanner and the photosensitive drum in a different form from FIG. 2A. In FIG. 2B, each of laser diodes LD1 (101) and LD2 (102) emits a laser beam based on results of detection performed by the color-misregistration detecting sensor 106 detecting a synchronization signal of the laser beam. Photosensitive drums 301 and 302 are scanned with the laser beams traveling in opposite directions (first and second scanning directions) emitted from the laser diodes LD1 and LD2 via a polygonal mirror 103 and reflectors 104 and 105, and an electrostatic latent image is formed on each of the photosensitive drums 301 and 302.

In the following embodiments, an image forming apparatus operable with various types of optical scanning in opposite directions, as illustrated in FIGS. 2A and 2B, is applicable.

Specific Example Structure of Color-Misregistration Detecting Sensor

Figure 3:
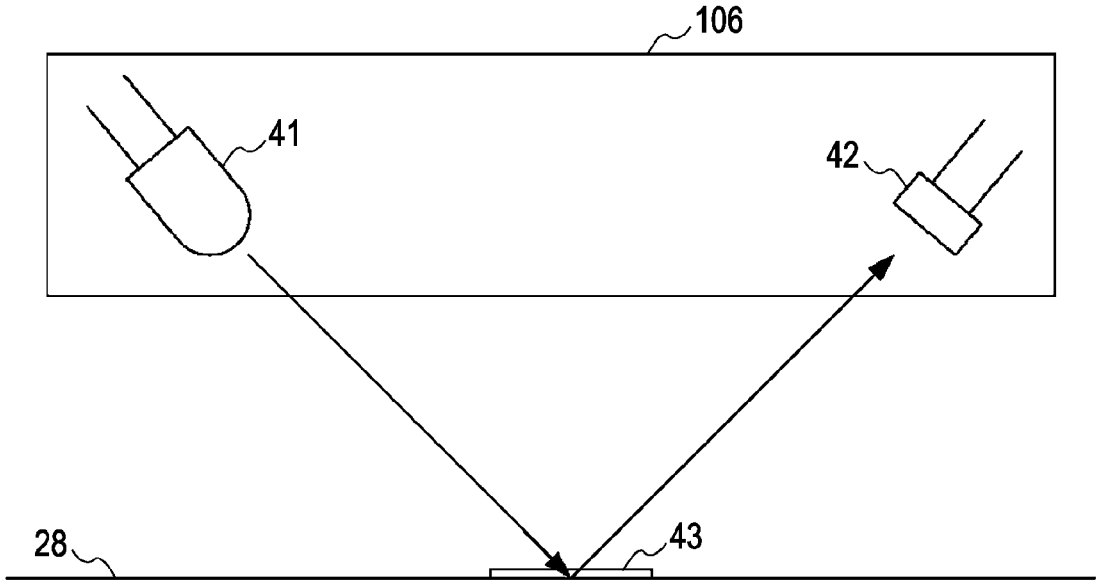
FIG. 3 illustrates one example of a configuration of a color-misregistration detecting sensor according to the first embodiment.

FIG. 3 illustrates an example of a configuration of the color-misregistration detecting sensor 106. The color-misregistration detecting sensor 106 includes a light-emitting device 41 (e.g., a light emitting diode (LED)), a photo detector 42 (e.g., a photodiode), a semiconductor integrated circuit (hereinafter referred to as an IC), not shown, and a holder (not shown) holding these components. The photo detector 42 detects the intensity of light reflected from a toner patch 43. In FIG. 3, specular reflected light is detected. However, the present invention is not limited to such detection. For example, light reflected via diffuse reflection may be detected. An optical device may be used to couple the light-emitting device 41 and the photo detector 42 together.

Figure 19A:
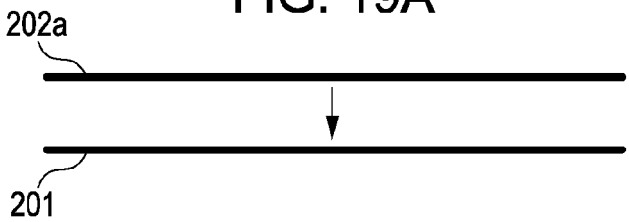
FIGS. 19A and 19B illustrate examples of color misregistration.
Figure 19B:
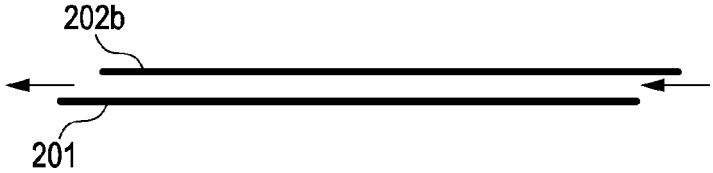

To correct color misregistration caused by an error of a position at which image formation starts in the main scanning direction (FIG. 19B), correction control of color misregistration is performed using the color-misregistration detecting sensor 106. Here, the correction control of color misregistration indicates control of forming a color misregistration detection pattern (a pattern image for detecting color misregistration) on the intermediate transfer member 28, detecting the amount of color misregistration using the color-misregistration detecting sensor 106, and correcting the time when image data is output such that color misregistration corresponding the detected amount is cancelled. The term "color misregistration" indicates relative positional displacement occurring between colors (more specifically, a reference color and a measured color) typically caused by improper alignment of colors (including a case in which there is no positional displacement between some of the colors). The amount of color misregistration indicates the amount of the relative positional displacement. In the following description, this is simply referred to as the amount of color misregistration.

Figure 4:
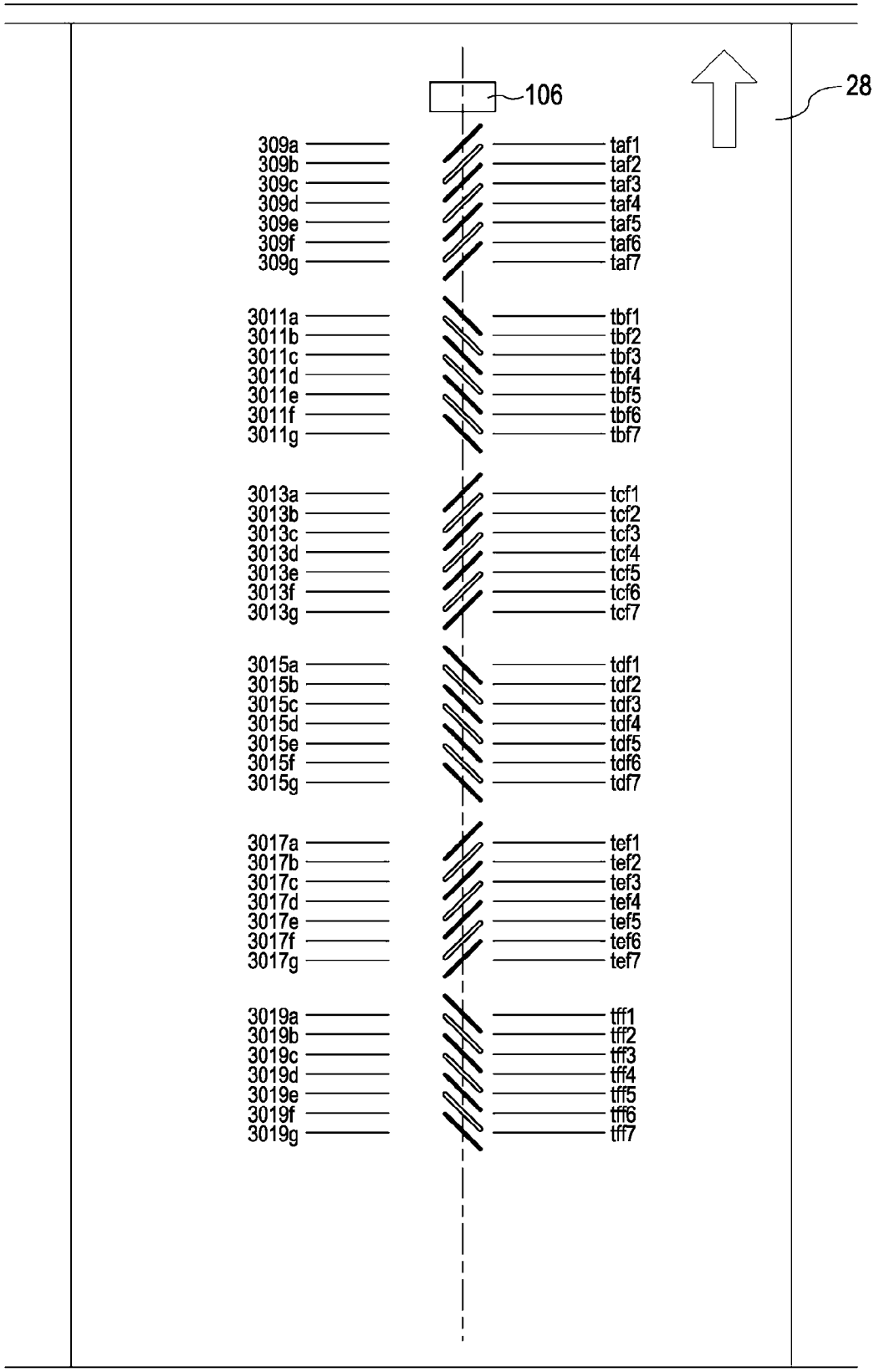
FIG. 4 illustrates one example of a color misregistration detection pattern for detecting color misregistration caused by an error of a position at which image formation starts in the main scanning direction according to the first embodiment.

FIG. 4 illustrates an example of a color misregistration detection pattern for detecting color misregistration caused by an error of a position at which image formation starts in the main scanning direction. The color-misregistration detecting sensor 106 is a light sensor disposed in the center in the main scanning direction and is configured to detect the color misregistration detection pattern formed on the intermediate transfer member 28. The color misregistration detection pattern includes pattern portions 309 to 3019 divided into three groups. The pattern portions 309 and 3011 constitute Pattern 1, the pattern portions 3013 and 3015 constitute Pattern 2, the pattern portions 3017 and 3019 constitute Pattern 3. Letters a, c, e, and g represent black (hereinafter referred to as K) being a reference color. Letters b, d, and f represent yellow (Y), magenta (M), and cyan (C), respectively, being colors to be detected. Characters taf1 to taf7, tbf1 to tbf7, tcf1 to tcf7, tdf1 to tdf7, tef1 to tef7, and tff1 to tff7 represent the times when the respective pattern portions are detected. The arrow represents the direction in which the intermediate transfer member 28 is moved. The speed at which the intermediate transfer member 28 is moved is expressed by v (mm/s), and the reference color is K. The amount of color misregistration δesf1 caused by an error of a position at which image formation starts in the main scanning direction when the pattern portions of Pattern 1 are detected is represented below.

$$\delta esf1Y=v*\{(taf2-taf1)-(taf3-taf2)-(tbf2-tbf1)+(tbf3-tbf2)\}/4 \quad (1)$$

$$\delta esf1M=v*\{(taf4-taf3)-(taf5-taf4)-(tbf4-tbf3)+(tbf5-tbf4)\}/4 \quad (2)$$

$$\delta esf1C=v*\{(taf6-taf5)-(taf7-taf6)-(tbf6-tbf5)+(tbf7-tbf6)\}/4 \quad (3)$$

In the same manner, the amount of color misregistration δesf2 caused by an error of a position at which image formation starts in the main scanning direction when the pattern portions of Pattern 2 are detected and the amount of color misregistration δesf3 caused by an error of a position at which an image formation starts in the main scanning direction when the pattern portions of Pattern 3 are detected are calculated.

As a result, the amount of color misregistration δes caused by an error of a position at which an image formation starts in the main scanning direction for each color is represented below.

$$\delta esY=(\delta esf1Y+\delta esf2Y+\delta esf3Y)/3 \quad (4)$$

$$\delta esM=(\delta esf1M+\delta esf2M+\delta esf3M)/3 \quad (5)$$

$$\delta esC=(\delta esf1C+\delta esf2C+\delta esf3C)/3 \quad (6)$$

The direction of misregistration can be determined from the sign of the calculated value.

The amount of color misregistration in the sub scanning direction for each color can be calculated in the same manner using the color misregistration detection pattern.

Figure 5:
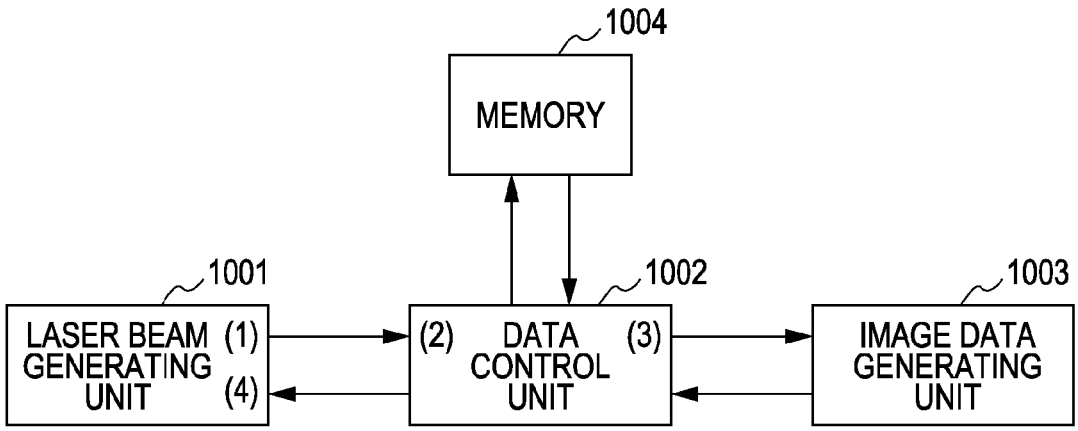
FIG. 5 is a block diagram that illustrates a configuration of a controller according to the first embodiment.

FIG. 5 illustrates the details of a controller that controls output of a laser beam. The laser beam generating unit 1001 generates a laser beam. The data control unit 1002 includes a processor (e.g., a one-chip microcomputer and a custom IC (application-specific IC (ASIC))) and a substrate and a conductor for transmitting a signal. The data control unit 1002 receives a laser beam detection signal output from the laser beam generating unit 1001 and transmits the laser beam detection signal to an image-data generating unit 1003. The image-data generating unit 1003 receives the laser beam detection signal transmitted from the data control unit 1002 and outputs an image data signal. A memory 1004 stores data. The image data signal output from the image-data generating unit 1003 is transmitted to the laser beam generating unit 1001 via the data control unit 1002. The laser beam generating unit 1001 forms an electrostatic latent image based on the image data signal (performs image writing). Generally, a color printer includes a beam detecting unit that contains, for example, a photo diode outside a scan area to maintain a starting position of recording in the main scanning direction constant (to synchronize image writing timings in the main scanning direction). The data control unit 1002 functions as a scanning-direction changing unit configured to change the direction in which a laser beam scans in accordance with a color and a scanning-speed changing unit configured to change the optical scanning speed, at which the laser beam scans, by controlling the laser beam generating unit 1001.

The beam detecting unit detects a laser beam proceeding to a scan area on a scan-by-scan basis and produces a synchronization detection signal (laser beam detection signal). After a predetermined period of time stored in the memory 1004 elapses from the synchronization detection signal, the data control unit 1002 outputs a signal to initiate output of an image data signal to the image-data generating unit 1003. For example, the data control unit 1002 counts the number of clocks of a picture frequency, and outputs a signal to initiate output of an image data signal to the image-data generating unit 1003 after the number of clocks reaches a threshold value T0. In response to this, the image-data generating unit 1003 outputs image data. In FIG. 5, (1) indicates the time when the laser beam generating unit 1001 outputs a laser beam detection signal (also referred to herein as "the time when image data is requested"), (2) indicates the time when the data control unit 1002 receives the laser beam detection signal, (3) indicates the time when the data control unit 1002 transmits the laser beam detection signal toward the image-data generating unit 1003, and (4) indicates the time when the laser beam generating unit 1001 receives image data via the data control unit 1002. A transmission delay occurs during the signal exchanges (1) to (4). The transmission delay causes color misregistration. The term transmission delay used herein indicates a delay time. This is sometimes called transmission delay time or simply transmission delay. These terms indicate the same meaning.

Operation of Correction Control of Color Misregistration

Figure 6:
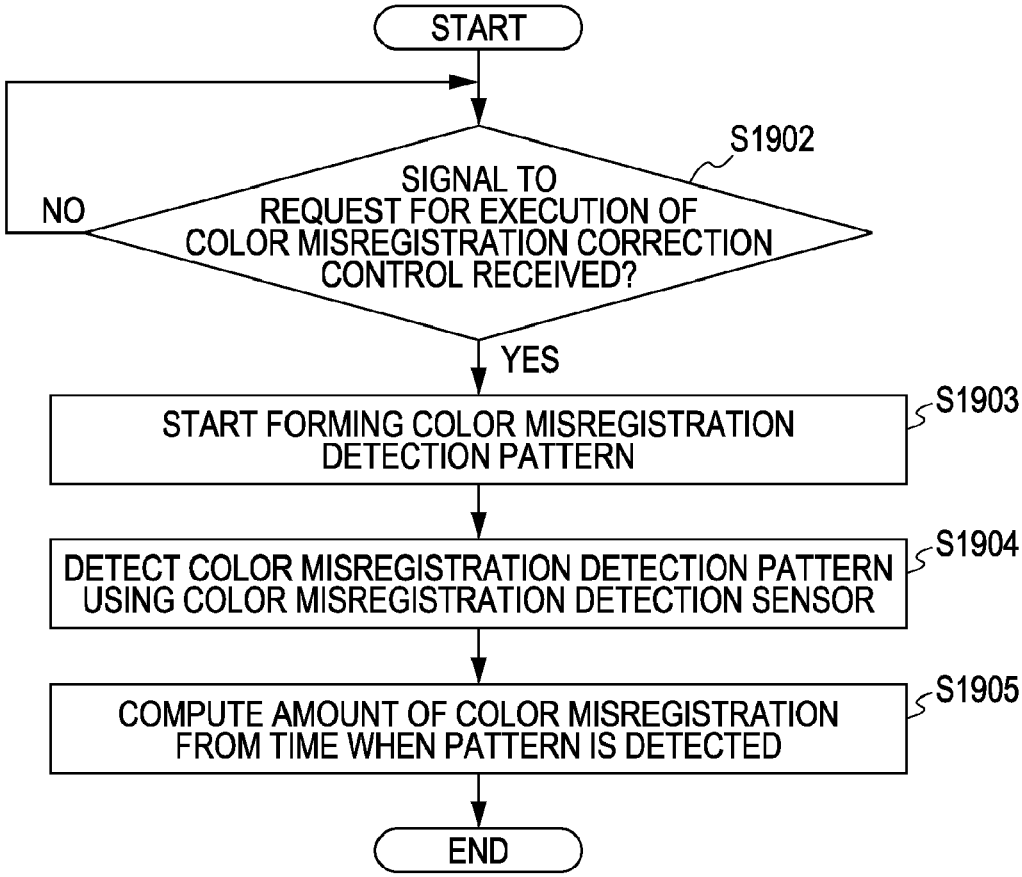
FIG. 6 is a flowchart of a process of an operation of correction control of color misregistration of the color printer according to the first embodiment.

FIG. 6 is a flowchart of a process of an operation of correction control of color misregistration of a color printer. Each of the laser scanners 24Y, 24M, 24C, and 24K emits a laser beam with rotation of a laser device (not shown) and a polygonal mirror (not shown) provided in the laser scanner at any speed on a line-by-line basis in the main scanning direction. In the description below, the speed at which a laser beam scans in the main scanning direction is referred to simply as a scanning speed or optical scanning speed.

In step S1902, it is monitored whether the data control unit 1002 receives a signal to request execution of correction control of color misregistration.

In step S1903, in response to reception of the signal to request execution of correction control of color misregistration by the data control unit 1002 (YES in step S1902), the operation of forming of a color misregistration detection pattern, as illustrated in FIG. 4, starts.

In step S1904, the color misregistration detection pattern is read by the color-misregistration detecting sensor 106. Because the color-misregistration detecting sensor 106 is described in detail above with reference to FIG. 3, the description of the color-misregistration detecting sensor 106 is not repeated here.

In step S1905, the amount of color misregistration to the reference color is calculated on the basis of the time when the color misregistration detection pattern is detected in step S1904. Calculating the amount of color misregistration used here indicates determining the amount of color misregistration itself or determining a parameter for identifying the amount of color misregistration. This determination of the amount of color misregistration itself or a parameter for identifying the amount of color misregistration is referred to as correction control of color misregistration or color misregistration correction control. In specific examples illustrated in FIGS. 10, 11, 12, 13, 14, and 16, described below, a correction time is used as the parameter for identifying the amount of color misregistration.

The relationship between the amount of correction of color misregistration and the correction time is expressed by the following equation (7):

$$\text{The correction time} \times \text{the counted number of clocks of a picture frequency} = \text{the amount of correction of color misregistration} \quad (7)$$

Generally, the amount of correction of color misregistration can be determined from a numerical value equal in magnitude to and opposite signed from the amount of color misregistration.

For example, when the resolution is 600 [dpi], the amount of correction of color misregistration is 0.1 [mm], the counted number of clocks of a picture frequency is 20000 (=the picture frequency 20 [kHz]), the correction time is determined by $$0.1/(25.4/600)\times(1/20000)\approx 118\ [\mu s] \quad (8)$$

Related Technique: Control without Consideration of Transmission Delay

To facilitate understanding the present embodiment, an operation of recording an electrostatic latent image without consideration of transmission delay will now be described as a technique related to the present embodiment, with reference to FIGS. 7 to 13.

Figure 7:
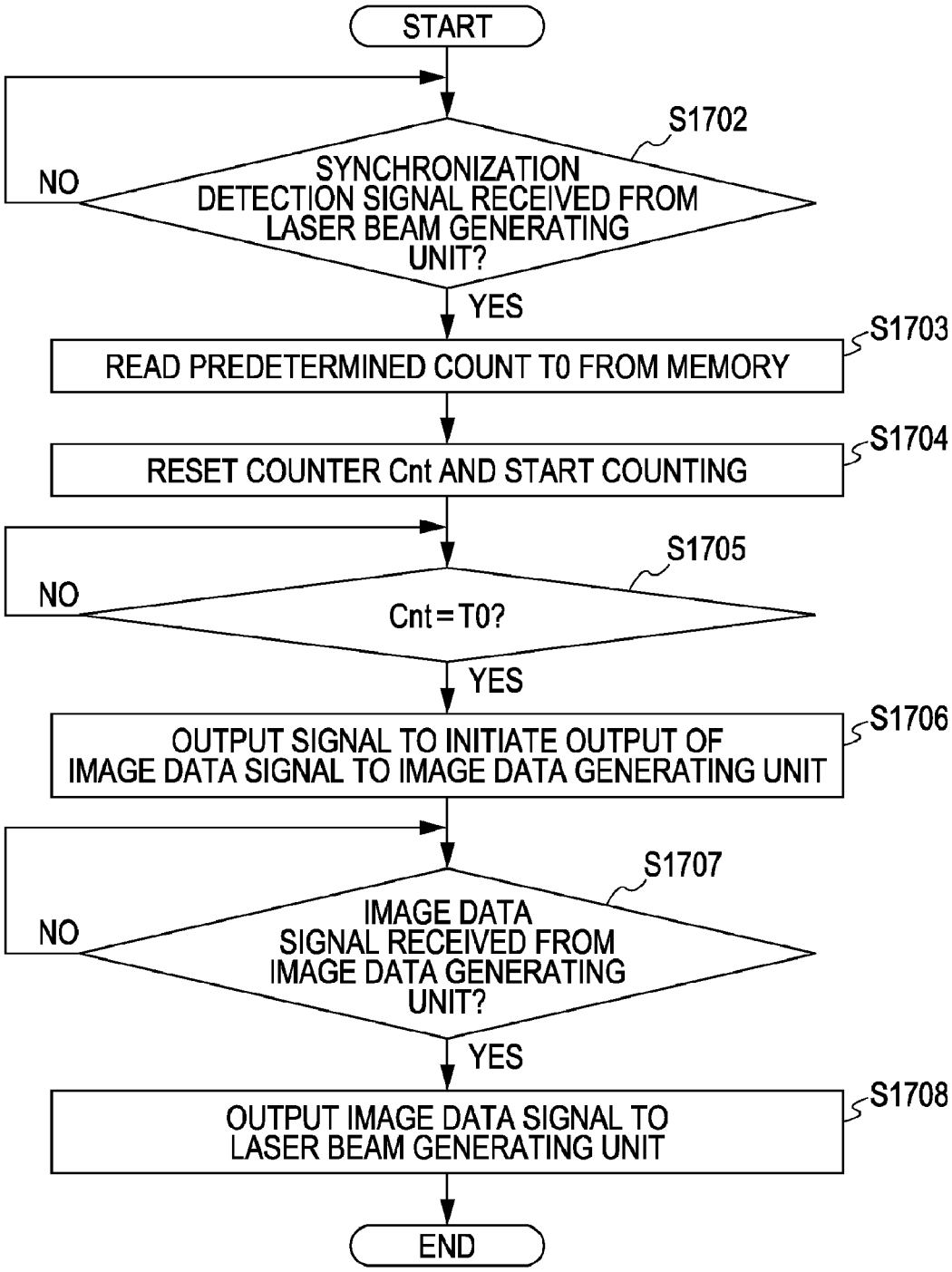
FIG. 7 is a flowchart of a process of an operation of controlling recording of an electrostatic latent image performed by a controller of a color printer according to a technique related to the present invention.

An operation of recording an electrostatic latent image without consideration of transmission delay and without performance of correction control of color misregistration will be first described using a flowchart illustrated in FIG. 7.

In step S1702, it is monitored whether the data control unit 1002 receives a synchronization detection signal output from the laser beam generating unit 1001.

In step S1703, in response to reception of the synchronization detection signal by the data control unit 1002 (YES in step S1702), the data control unit 1002 reads a pre-stored count T0 (T0>0) from the memory 1004. The count T0 enables an image to be recorded from the left end of a sheet.

In step S1704, a counter Cnt incorporated in the data control unit 1002 is reset to zero, and counting the time is started.

In step S1705, it is determined whether the time count of the counter Cnt becomes equal to T0.

In step S1706, in response to the time count of the counter Cnt becoming equal to T0 (YES in step S1705), the data control unit 1002 outputs a signal to initiate output of an image data signal to the image-data generating unit 1003.

In step S1707, it is monitored whether the data control unit 1002 receives the image data signal output from the image-data generating unit 1003.

In step S1708, in response to reception of the image data signal output from the image-data generating unit 1003 by the data control unit 1002 (YES in step S1707), the data control unit 1002 outputs the image data signal to the laser beam generating unit 1001.

Figure 8:
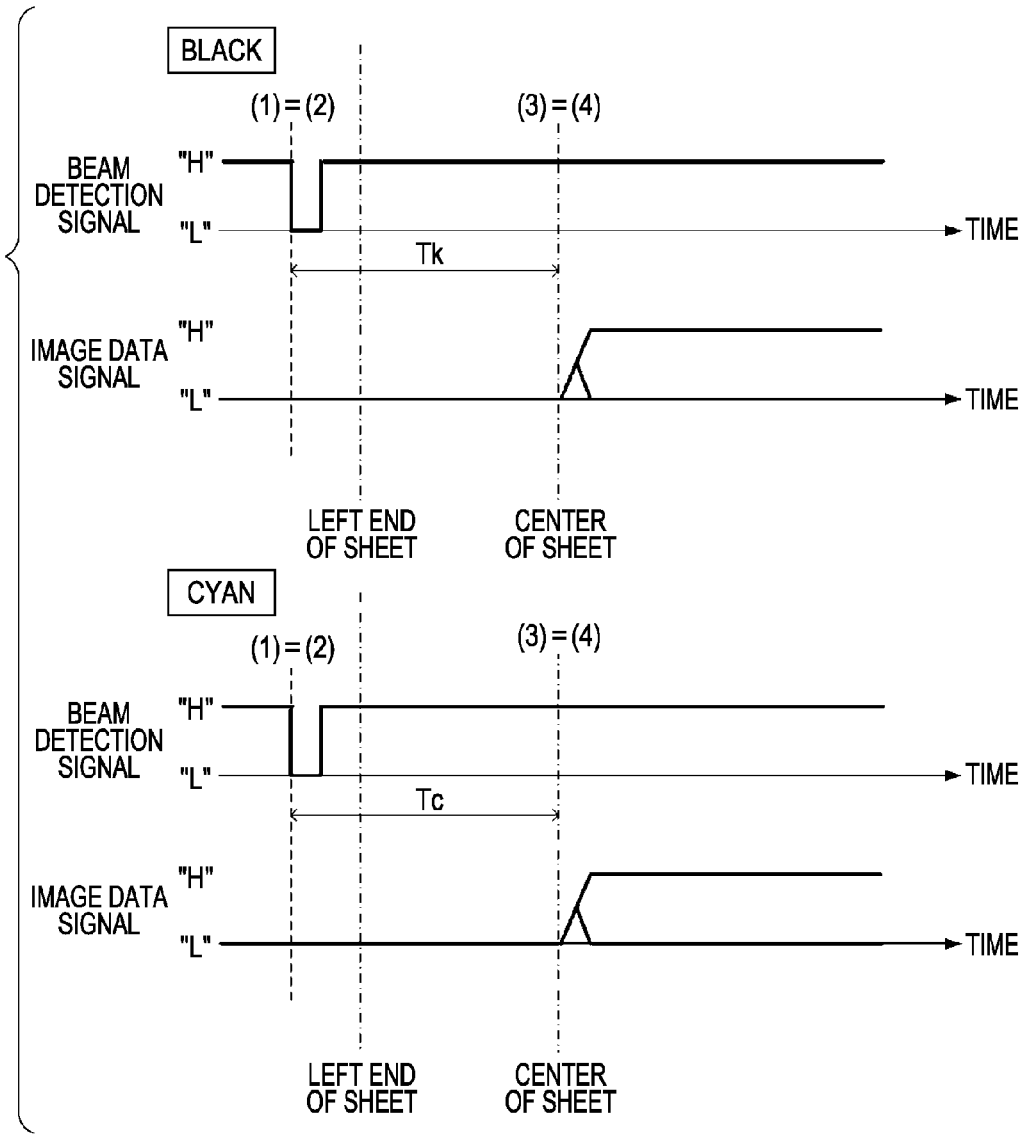
FIG. 8 is a timing chart that illustrates behavior of a laser beam detection signal and an image data signal when there is no transmission delay according to the related technique.

FIG. 8 is a timing chart that illustrates behavior of a laser beam detection signal and an image data signal when an image is recorded from the center of a sheet with the assumption that there is no transmission delay. In FIG. 8, Tk indicates a time counted from a laser beam detection signal to formation of an electrostatic latent image of black at the center thereof, and Tc indicates a time counted from a laser beam detection signal to formation of an electrostatic latent image of cyan at the center thereof. When there is no transmission delay, the time (1) and the time (2) when the data control unit receives the request, illustrated in FIG. 5, are the same, and the time (3) when the data control unit instructs formation of image data is simultaneous with the time (4) when the image data is input.

Figure 9:
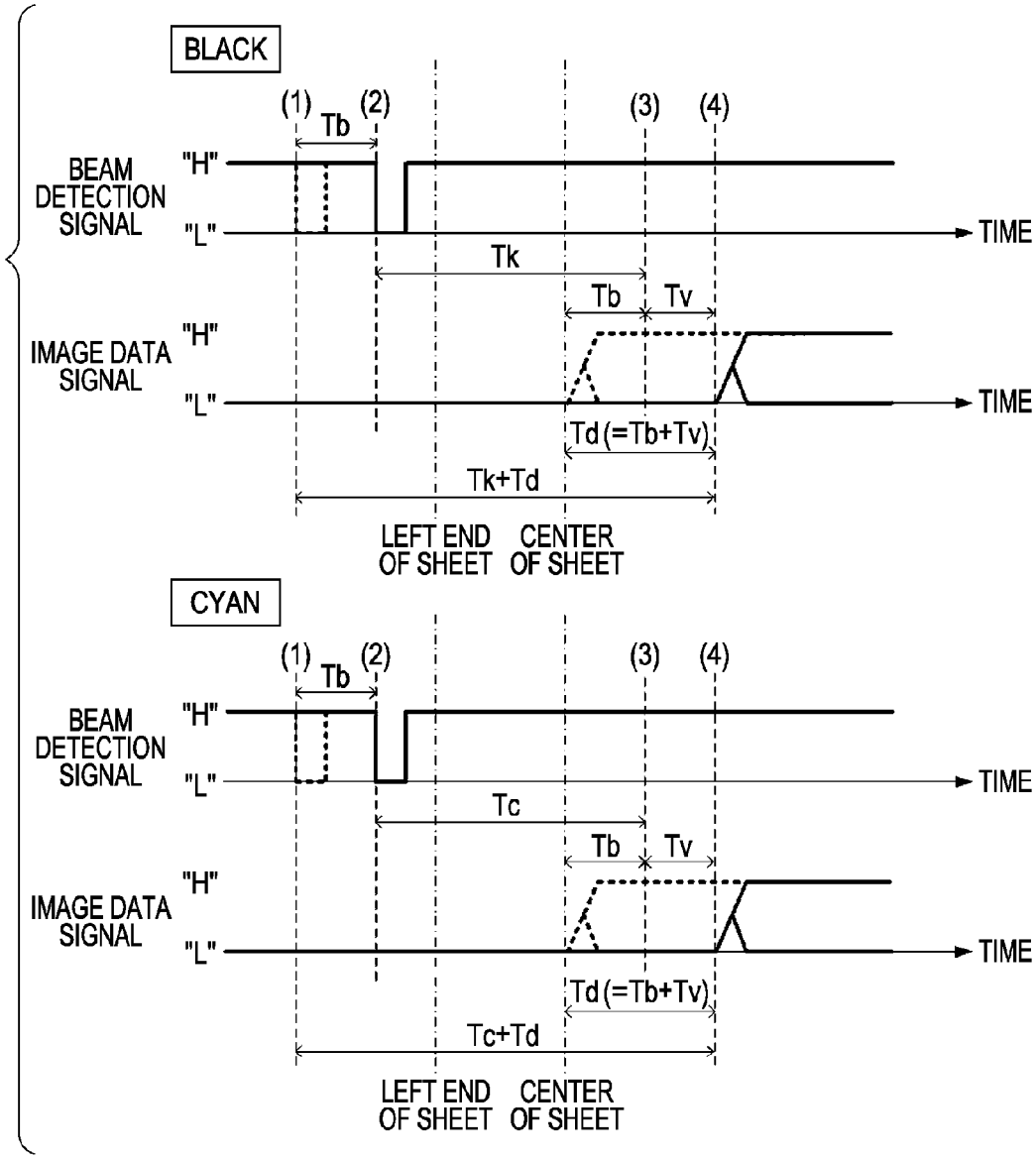
FIG. 9 is a timing chart that illustrates behavior of a laser beam detection signal and an image data signal when there is a transmission delay according to the related technique.

In contrast to this, FIG. 9 is a timing chart that illustrates behavior of a laser beam detection signal and an image data signal when color misregistration resulting from transmission delay occurs and correction control of color misregistration is not performed. For the sake of clarity, in FIG. 9, an image is recorded from the center of a sheet, and it is assumed that the transmission delay time is the same, irrespective of color. Also in the description below, black is the reference color for correction control of color misregistration, and the transmission delay time is the same, irrespective of color. Tb indicates the delay time occurring during transmission of a laser beam detection signal from the laser beam generating unit 1001 to the data control unit 1002, that is, the delay time between (1) and (2) illustrated in FIG. 5. Tv indicates the delay time occurring between the time when the data control unit 1002 transmits an instruction signal to generate image data toward the image-data generating unit 1003 and the time when the image data reaches the laser beam generating unit 1001, that is, the delay time between (3) and (4) illustrated in FIG. 5.

Td indicates the transmission delay time (the sum of Tb and Tv) between the time when the laser beam generating unit 1001 transmits a laser beam detection signal and the time when the laser beam generating unit 1001 receives the image data signal. The transmission delay causes the time when a laser beam based on image data is output to lag by Td. When the scanning speed is M, an image is recorded at a location that is displaced from the center (or a desired position) by MTd.

Figure 10:
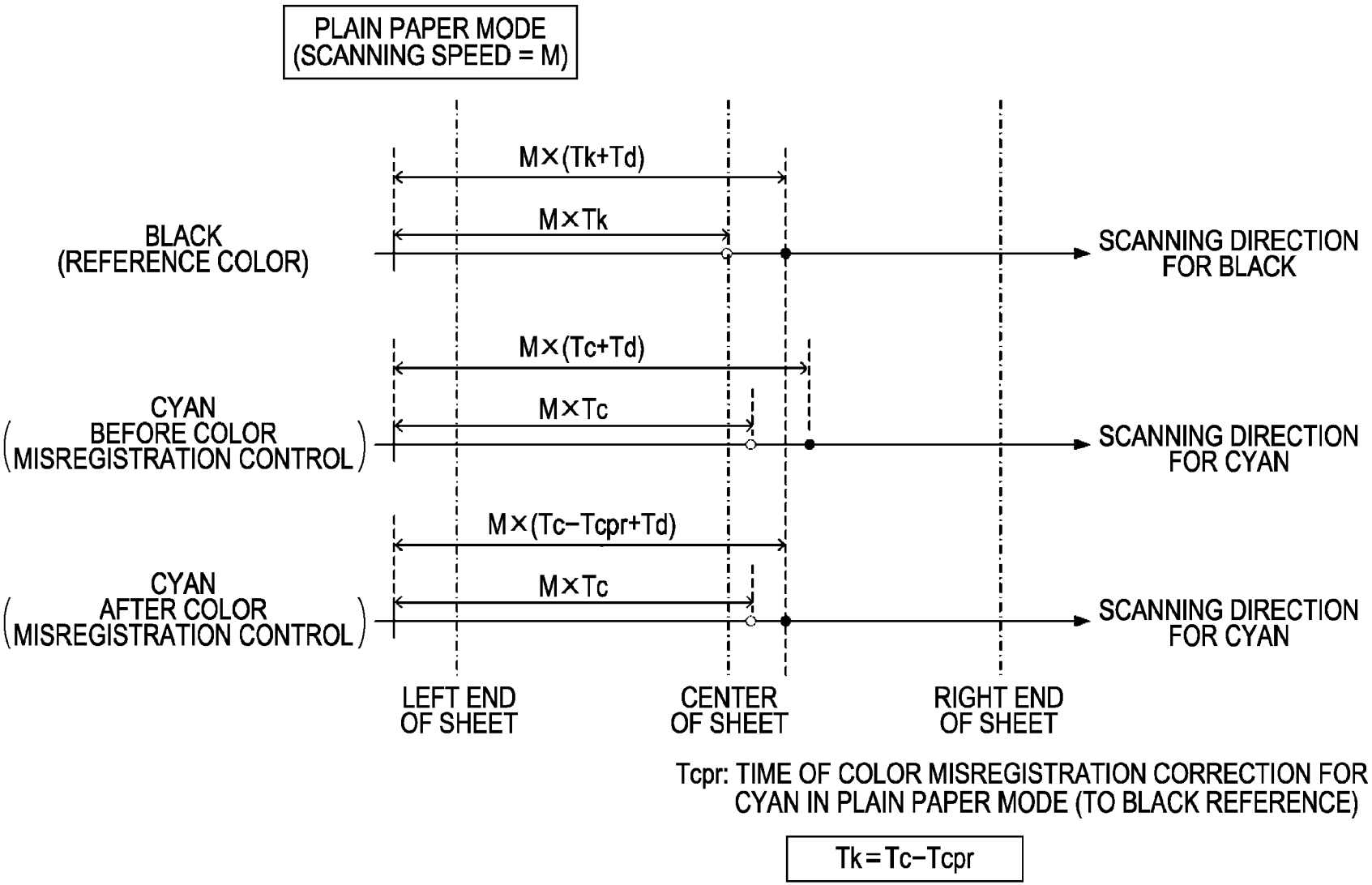
FIG. 10 illustrates correction of color misregistration in the plain-paper mode when the scanning direction for the reference color and the scanning direction for another color are the same according to the related technique.

To address this, in a plain-paper mode, a correction time Tcpr is determined by performing correction control of color misregistration on cyan. FIG. 10 illustrates a position at which an image is recorded when the scanning direction for the reference color and the scanning direction for another color are the same in the plain-paper mode and correction control of color misregistration is performed. In the following description, a reference color and another color are sometimes referred to as a first color and a second color to distinguish between them. However, there is no special significance to the reference color being the first color. The reference color may be referred to as the second color.

Scans Performed in the Same Optical Scanning Direction for Different Colors

In FIG. 10, M indicates the scanning speed in the plain-paper mode. For the sake of clarity, a case in which an electrostatic latent image (dot) is intended to be recorded at the center of the image in the main scanning direction is described. A white dot indicates a position at which an electrostatic latent image is formed when there is no transmission delay. A black dot indicates a position at which an electrostatic latent image is formed when a transmission delay is present. When a transmission delay is present, forming an image lags by a transmission delay time. As a result, the position at which an electrostatic latent image is formed is displaced downstream in the main scanning direction. In this state, when correction control of color misregistration is performed on cyan, the time when an electrostatic latent image of cyan is formed is corrected by Tcpr such that the position at which the cyan electrostatic latent image is formed becomes equal to the position at which an electrostatic latent image of black being the reference color is formed. Accordingly, in the plain-paper mode, color misregistration does not occur between black and cyan under the following condition:

$$Tk=Tc-Tcpr \tag{9}$$

This is because, in correction control of color misregistration, Tcpr is determined such that the time Tk counted from a synchronization detection signal to formation of an electrostatic latent image of black at the center thereof is equal to Tc−Tcpr.

Figure 11:
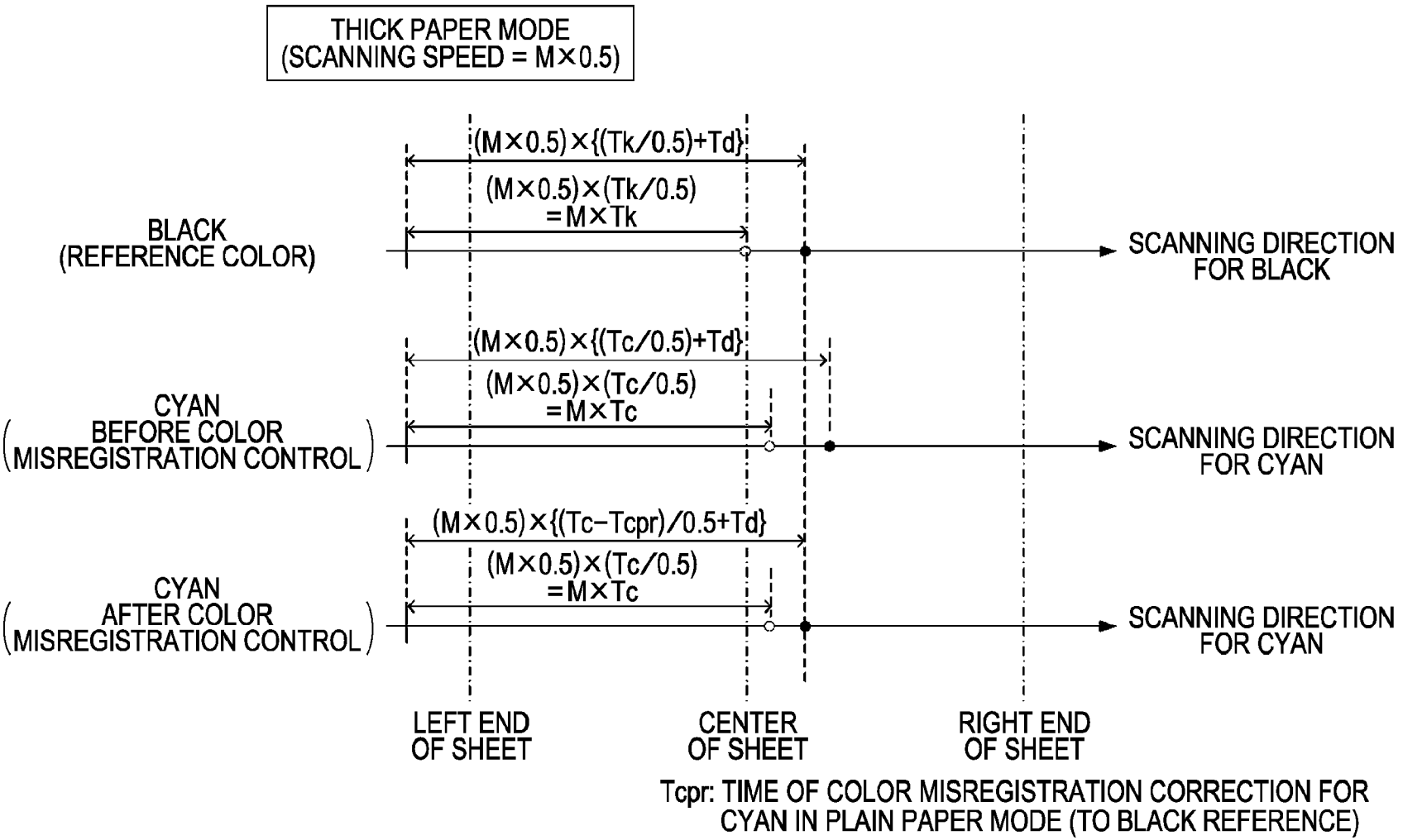
FIG. 11 illustrates correction of color misregistration in a thick-paper mode when the scanning direction for the reference color and the scanning direction for another color are the same according to the related technique.

FIG. 11 illustrates a position at which an image is recorded when the scanning direction for the reference color and the scanning direction another color are the same in a thick-paper mode. This thick-paper mode is one example of an operation mode that has a different scanning speed from that in the plain-paper mode described above. The present invention is characteristic in that there are operation modes having different optical scanning speeds (e.g., a first scanning speed, a second scanning speed, . . . ) and different scanning directions of laser beams. In other words, the present invention is specific to a color image forming apparatus operable in operation modes including a first operation mode having a first optical scanning speed and a second operation mode having a second optical scanning speed different from the first optical scanning speed. In the following description, the plain-paper mode (first operation mode) and the thick-paper mode (second operation mode) will be described as examples of the operation modes having different scanning speeds.

Referring back to the description of the thick-paper mode, M indicates the scanning speed in the plain-paper mode, and Tcpr indicates the correction time when correction control of color misregistration is performed on cyan in the plain-paper mode. Generally, the thickness of a nip between fixing rollers varies according to the material of a conveyed sheet (e.g., type or thickness), so it is necessary to switch the speed at which sheets are conveyed according to characteristics of a conveyed sheet. At this time, it is necessary to change the scanning speed and the time when an electrostatic latent image is formed in response to the conveying speed. To this end, the color printer in the present embodiment is operable in the plain-paper mode and thick-paper mode, and the data control unit 1002 functions as a scanning-speed changing unit so as to change the scanning speed of a laser beam in both the plain-paper mode and the thick-paper mode.

In FIG. 11, by way of example, the scanning speed in the thick-paper mode is 0.5 times the scanning speed in the plain-paper mode (M×0.5) and the time of forming an electrostatic latent image is 2 times (=1/0.5) the time in the plain-paper mode.

At this time, the position at which the electrostatic latent image is formed is displaced downstream by M×0.5×Td from the position at which the electrostatic latent image is formed in the plain-paper mode. This displacement is produced by the transmission delay time being the same irrespective of the scanning speed.

However, the displacement in the position at which the electrostatic latent image is formed caused by influence of the transmission delay time occurs in both cyan and black. As a result, color misregistration does not occur between black and cyan in the thick-paper mode. At this time, the position at which an electrostatic latent image of black at the center thereof is formed from a synchronization detection signal is determined by $$(M\times 0.5)\times\{(Tk/0.5)+Td\}=M\times Tk+M\times 0.5\times Td \tag{10}$$

The position at which an electrostatic latent image of cyan at the center thereof is formed from a synchronization detection signal after correction control of color misregistration is performed on cyan is determined by $$(M\times 0.5)\times\{(Tc-Tcpr)/0.5+Td\}=M\times(Tc-Tcpr)+M\times 0.5\times Td \tag{11}$$

Because Tcpr is determined on the condition of equation (9), equations (10) and (11) have the same value. Therefore, in the thick-paper mode, color misregistration does not occur between black and cyan.

Scans Performed in different Optical Scanning Directions for Different Colors

Figure 12:
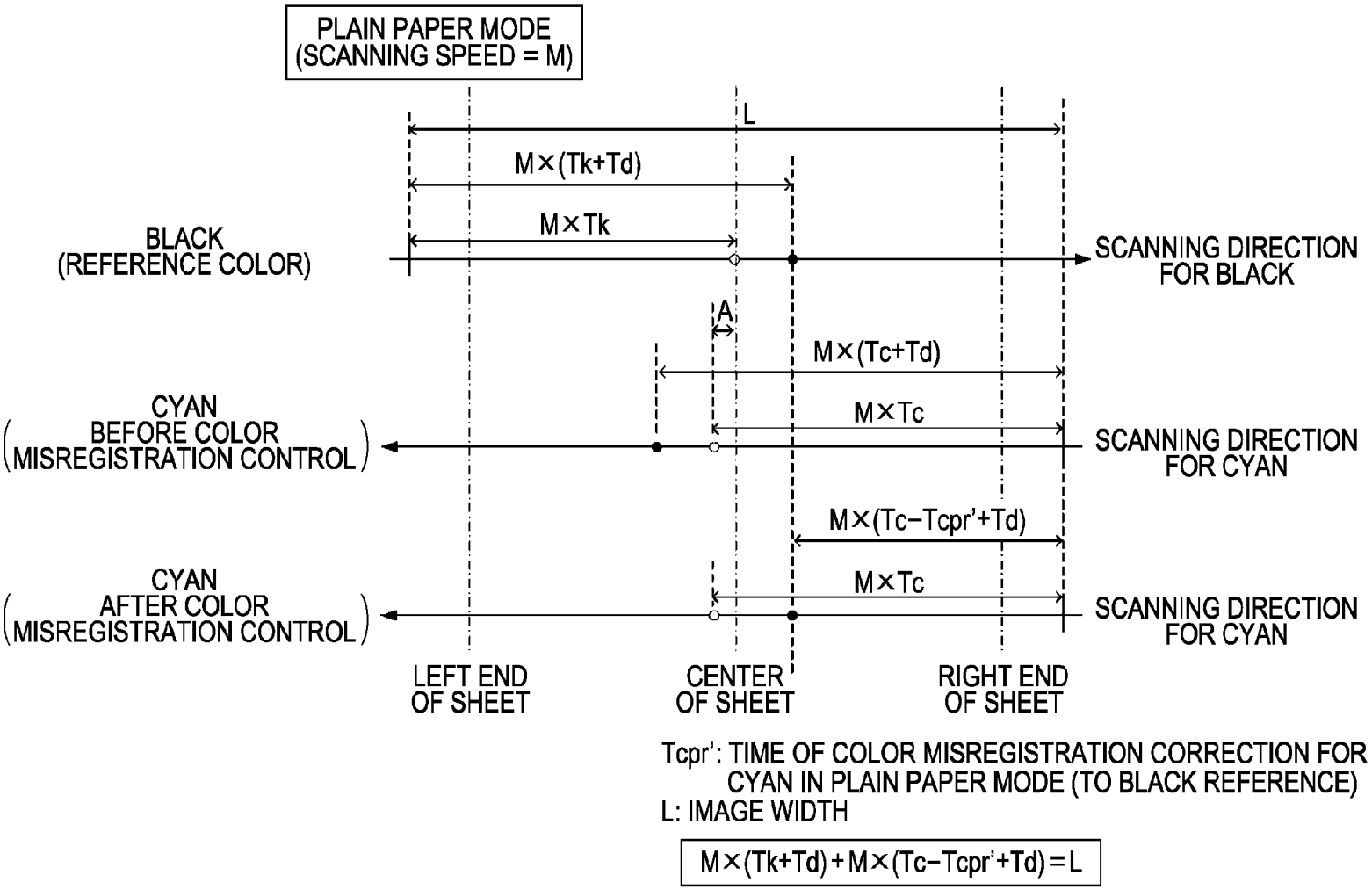
FIG. 12 illustrates correction of color misregistration in the plain-paper mode when the scanning direction for the reference color and the scanning direction for another color are different according to the related technique.

FIG. 12 illustrates correction of color misregistration in the plain-paper mode when the scanning direction for the reference color and the scanning direction another color are different. M indicates the scanning speed in the plain-paper mode. Tcpr' indicates the correction time when correction control of color misregistration is performed on cyan in the plain-paper mode. The correction time Tcpr' can be detected by formation of a color misregistration detection pattern.

Reference letter "A" indicates the amount of color misregistration between cyan and black before correction control of color misregistration is performed on cyan when there is no transmission delay. When there is transmission delay, as in the case of FIG. 10, forming an image lags by the length of the transmission delay time. As a result, the position at which an electrostatic latent image is formed is displaced downstream in the main scanning direction. In this state, when correction control of color misregistration is performed on cyan, the time when an electrostatic latent image of cyan is formed is corrected by Tcpr' such that the position at which the cyan electrostatic latent image is formed becomes equal to the position at which an electrostatic latent image of black being the reference color is formed.

As a result, in the plain-paper mode, color misregistration does not occur between black and cyan under the following conditions:

$$M\times(Tk+Td)+M\times(Tc-Tcpr'+Td)=L \tag{12}$$

$$L-M\times(Tk+Td)=M\times(Tc-Tcpr'+Td) \tag{13}$$

where L indicates the width of an image formed in one scan.

Figure 13:
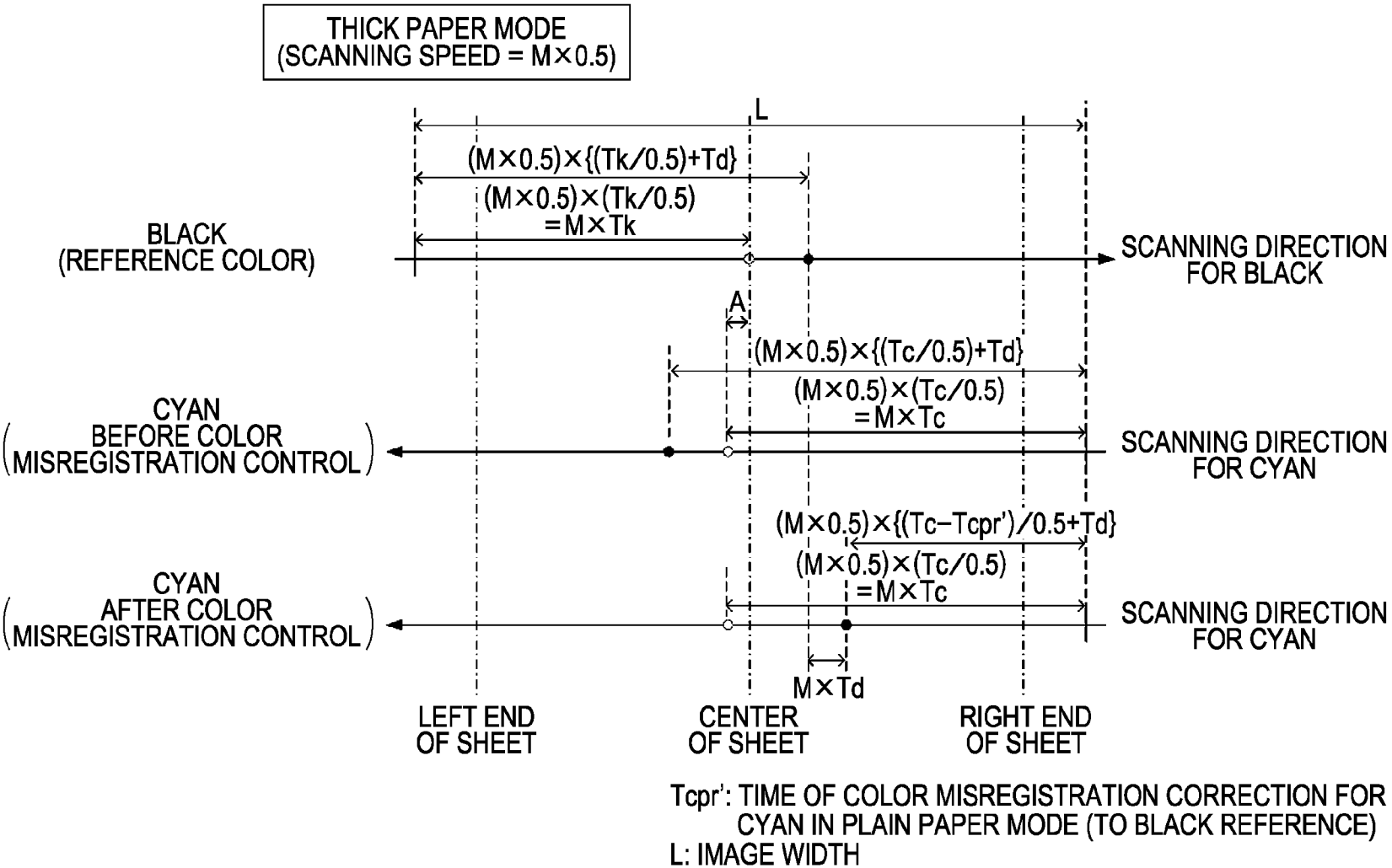
FIG. 13 illustrates correction of color misregistration in the thick-paper mode when the scanning direction for the reference color and the scanning direction for another color are different according to the related technique.

FIG. 13 illustrates color misregistration correction in the thick-paper mode when the scanning direction for the reference color and the scanning direction for another color are different. In FIG. 13, by way of example, the scanning speed in the thick-paper mode is 0.5 times the scanning speed in the plain-paper mode (M×0.5) and the time of forming an electrostatic latent image is 2 times (=1/0.5) the time in the plain-paper mode, as in the case of FIG. 11.

The position at which an electrostatic latent image of black is formed with reference to the left end of the image width is determined by $$(M\times 0.5)\times\{(Tk/0.5)+Td\} \tag{14}$$

The position at which an electrostatic latent image of cyan is formed with reference to the right end of the image width is determined by $$(M\times 0.5)\times\{[(Tc-Tcpr')/0.5]+Td\} \tag{15}$$

Here, the amount of correction Tcpr' when correction control of color misregistration is performed on cyan is the same as the amount of correction calculated by the correction control of color misregistration in the plain-paper mode.

The amount of color misregistration in the thick-paper mode is determined by $$\begin{aligned}
&\{L-\text{Equation (14)}\}-\text{Equation (15)}= \\
&\quad L-(M\times 0.5)\times\{(Tk/0.5)+Td\}- \\
&\quad (M\times 0.5)\times\{[(Tc-Tcpr')/0.5]+Td\}= \\
&\quad L-M\times(Tk+0.5\times Td)-M\times(Tc-Tcpr'+0.5\times Td)= \\
&\quad L-M\times(Tk+Td)+M\times 0.5\times Td- \\
&\quad M\times(Tc-Tcpr'+0.5\times Td)= \\
&\quad L-M\times(Tk+Td)-M\times(Tc-Tcpr') \\
&\text{From equation (12),}\ =M\times(Tc-Tcpr'+Td)-M\times(Tc-Tcpr')= \\
&\quad M\times Td
\end{aligned} \tag{16}$$

Accordingly, a color misregistration of M×Td [dot] undesirably occurs.

In FIG. 13, by way of example, the scanning speed in the thick-paper mode is 0.5 times the scanning speed in the plain-paper mode (M×0.5). However, the scaling factor is not limited to 0.5 times. Generally, the scanning speed in the thick-paper mode is 1/m times (m>0) the scanning speed in the plain-paper mode. At this time, when the scanning direction for the reference color and the scanning direction another color are different, the amount of color misregistration occurring between the reference color and another color in the thick-paper mode can be represented by $$(2-2/m)\times M\times Td[\text{dot}](m>0) \tag{17}$$

from a similar calculation to equations (14), (15), and (16). For example, the amount of color misregistration occurring when m=2 (0.5 times the scanning speed in the plain-paper mode) can be represented by M×Td [dot], and the amount of color misregistration occurring when m=4 (0.25 times the scanning speed in the plain-paper mode) can be represented by 1.5×M×Td [dot]. The amount defined by equation (16) corresponds to the difference between the amounts of delay color misregistration in operation modes. The details of the amount of delay color misregistration will be described below.

As described above, when a color image forming apparatus that is operable in print modes for different scanning speeds and that can perform scanning the reference color and scanning another color in different scanning speeds uses, in a second mode, a color misregistration correction time calculated in a first print mode, color misregistration occurs. This is color misregistration expressed by equation (17) resulting from a delay in a transmission path, such as a line, an electric device, and a pattern on a substrate.

Control Considering Transmission Delay

Characteristics of the embodiments of the present invention will now be described below with reference to the drawings. One of the characteristics is that both a first operation mode (for example, the plain-paper mode) and a second operation mode (for example, the thick-paper mode) share the common amount of correction of color misregistration based on the amount of color misregistration determined through the flowchart of FIG. 6. Here, sharing the common amount of correction of color misregistration in different modes means that similar color misregistration is eliminated or suppressed using the same amount of correction of color misregistration in all of the different modes. It does not indicate a case in which, although the amount of correction of color misregistration used in a first operation mode is also used in a second operation mode, the degree of a reduction in the amount of color misregistration in the second operation mode is significantly lower than that in the first operation mode.

To share the common amount of correction of color misregistration in modes, at least one of a plurality of laser beam generating units emits a laser beam with image writing timing that enables the difference between the amount of delay color misregistration in a first operation mode and that in a second operation mode to be reduced.

The amount of delay color misregistration used herein is the amount of color misregistration defined by an image writing position when an optical scan is performed in the first scanning direction in response to the transmission delay and an image writing position when an optical scan is performed in the second scanning direction in response to the transmission delay. The first scanning direction corresponds to, for example, the scanning direction for black illustrated in FIG. 13, whereas the second scanning direction corresponds to, for example, the scanning direction for cyan illustrated in FIG. 13. In the case of FIG. 13, for example, M×Td [dot] is the difference between the amounts of delay color misregistration in operation modes. The existence of this amounts of delay color misregistration results in being unable to use the common amount of correction of color misregistration determined through the flowchart of FIG. 6 in the modes.

A characteristic technical idea of the embodiments of the present invention is that it focuses on the difference between the amounts of delay color misregistration and any one or more of laser beam generating units emit a laser beam with image writing timing that enables the difference between the amounts of delay color misregistration to be reduced. The embodiments described below will enable a person skilled in the art to understand the meaning of emitting a laser beam from any one or more of laser beam generating units with image writing timing that enables the difference between the amounts of delay color misregistration to be reduced.

The description will be provided as follows:

(1) In the first embodiment, each of a laser beam generating unit for a reference color and a laser beam generating unit for a measured color whose scan is performed in a different scanning direction from that for the reference color emits a laser beam with image writing timing that enables the difference between the amounts of delay color misregistration to be reduced.

(2) In second and third embodiments, the transmission delay time is updated so as to support a situation where the transmission delay time is dynamically changed by degradation in an apparatus with time or environmental change.

(3) In a fourth embodiment, another form of the case where any one or more of laser generating units emit a laser beam with image writing timing that enables the difference between the amounts of delay color misregistration to be reduced will be described. More specifically, the transmission delay time is considered for only image writing timing for a reference color or only that for a measured color.

(4) In the first to fourth embodiments, in both a plain-paper mode (first operation mode) and a thick-paper mode (second operation mode), image writing is performed using one or more laser beam generating units with image writing timing that enables the difference between the amounts of delay color misregistration to be reduced. However, the present invention is not limited to these embodiments. For example, in at least one of a plurality of operation modes, image writing may be performed using the laser beam generating unit with image writing timing that enables the difference between the amounts of delay color misregistration to be reduced. This case will be described in a fifth embodiment.

(5) In a sixth embodiment, a case where different transmission delay times can occur for each color will be described. The present invention is also applicable to this case.

In the following description, various forms for, in consideration of transmission delay, emitting a laser beam from each of a laser beam generating unit for a reference color and a laser beam generating unit for a measured color whose scan is performed in a different scanning direction from that for the reference color with image writing timing that enables the difference between the amounts of delay color misregistration to be reduced will be sequentially described.

Figure 14:
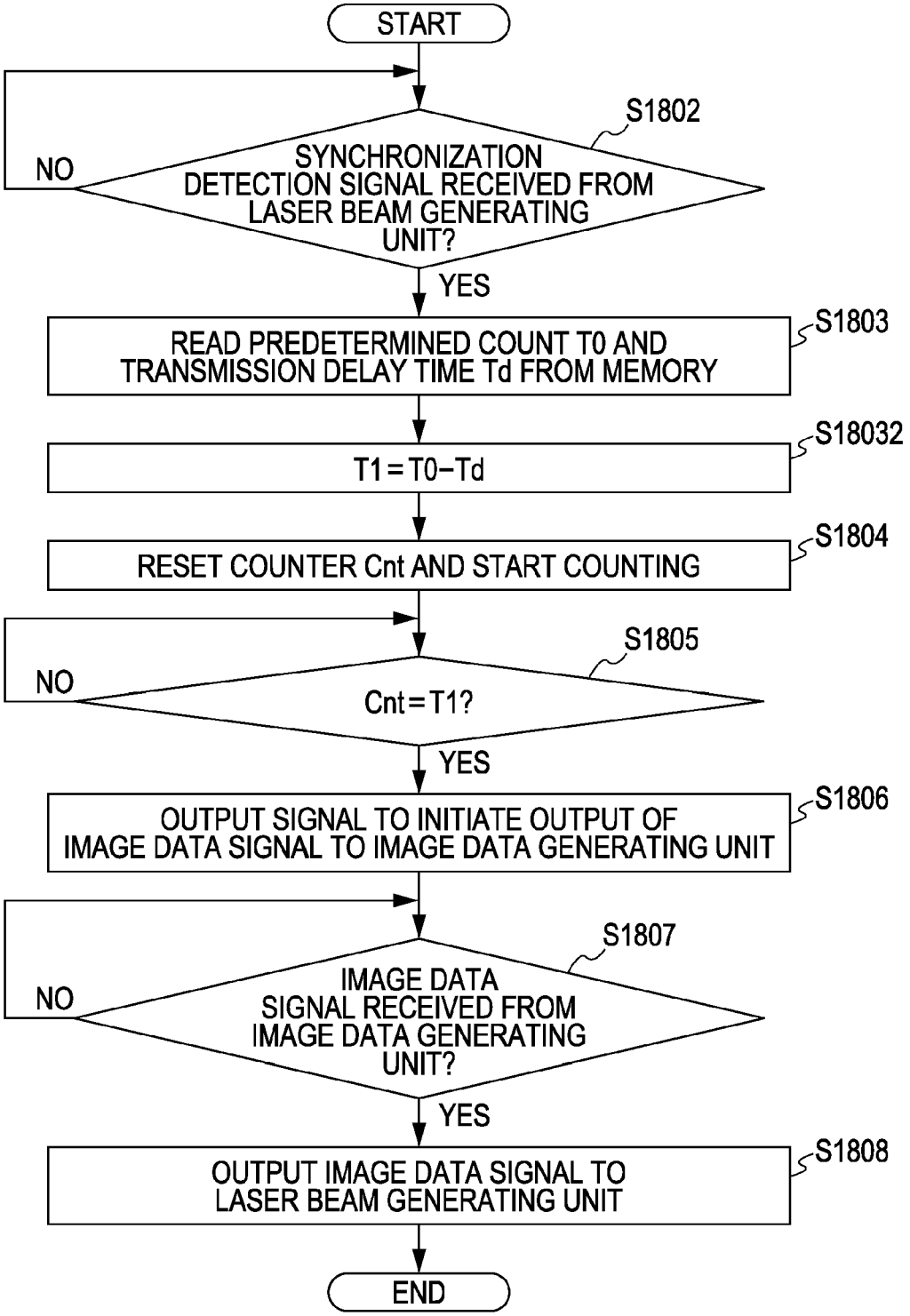
FIG. 14 is a flowchart of a process of an operation of controlling recording of an electrostatic latent image of the color printer according to the first embodiment.

FIG. 14 is a flowchart of a process of an operation performed by the data control unit 1002 when an electrostatic latent image is recorded while the transmission delay time Td is corrected. For each color unit, the transmission delay time Td from output of a laser beam detection signal from the laser beam generating unit 1001 to input of an image data signal into the laser beam generating unit 1001 is measured by a measuring device (e.g., an oscilloscope) and stored in the memory 1004 in advance. To record an electrostatic latent image in which the result of correction control of color misregistration described with reference to FIG. 6 is reflected, T1=T0−Td−Tcpr" is used in step S18032 in FIG. 14. The details will be described using numerical expressions after the description for FIG. 15.

In step S1802, it is monitored whether the data control unit 1002 receives a synchronization detection signal output from the laser beam generating unit 1001.

In step S1803, in response to reception of the synchronization detection signal by the data control unit 1002 (YES in step S1802), the data control unit 1002 reads the previously stored time count T0 (T0>0) and transmission delay time Td from the memory 1004. Under the same transmission delay characteristics, the value T0 here is the same as the value T0 described with reference to FIG. 7.

In step S18032, the transmission delay time Td is subtracted from the time count, and the result is stored as a count time T1 (T1>0). That is, the data control unit 1002 subtracts the transmission delay time Td from the time counted from a synchronization detection signal to formation of an electrostatic latent image in each color unit. In the present embodiment, the subtraction of the transmission delay time Td from the time count is carried out by the data control unit 1002. However, that subtraction may be carried out by the image-data generating unit 1003. This is because the transmission delay time Td is a numerical value previously stored.

In step S1804, the counter Cnt incorporated in the data control unit 1002 is reset to zero, and counting time is started.

In step S1805, it is determined whether the time count of the counter Cnt becomes equal to T1.

In step S1806, in response to the time count of the counter Cnt becoming equal to T1 (YES in step S1805), the data control unit 1002 outputs a signal to initiate output of an image data signal to the image-data generating unit 1003.

In step S1807, it is monitored whether the data control unit 1002 receives the image data signal output from the image-data generating unit 1003.

In step S1808, in response to reception of the image data signal output from the image-data generating unit 1003 by the data control unit 1002 (YES in step S1807), the data control unit 1002 outputs the image data signal to the laser beam generating unit 1001.

Figure 15:
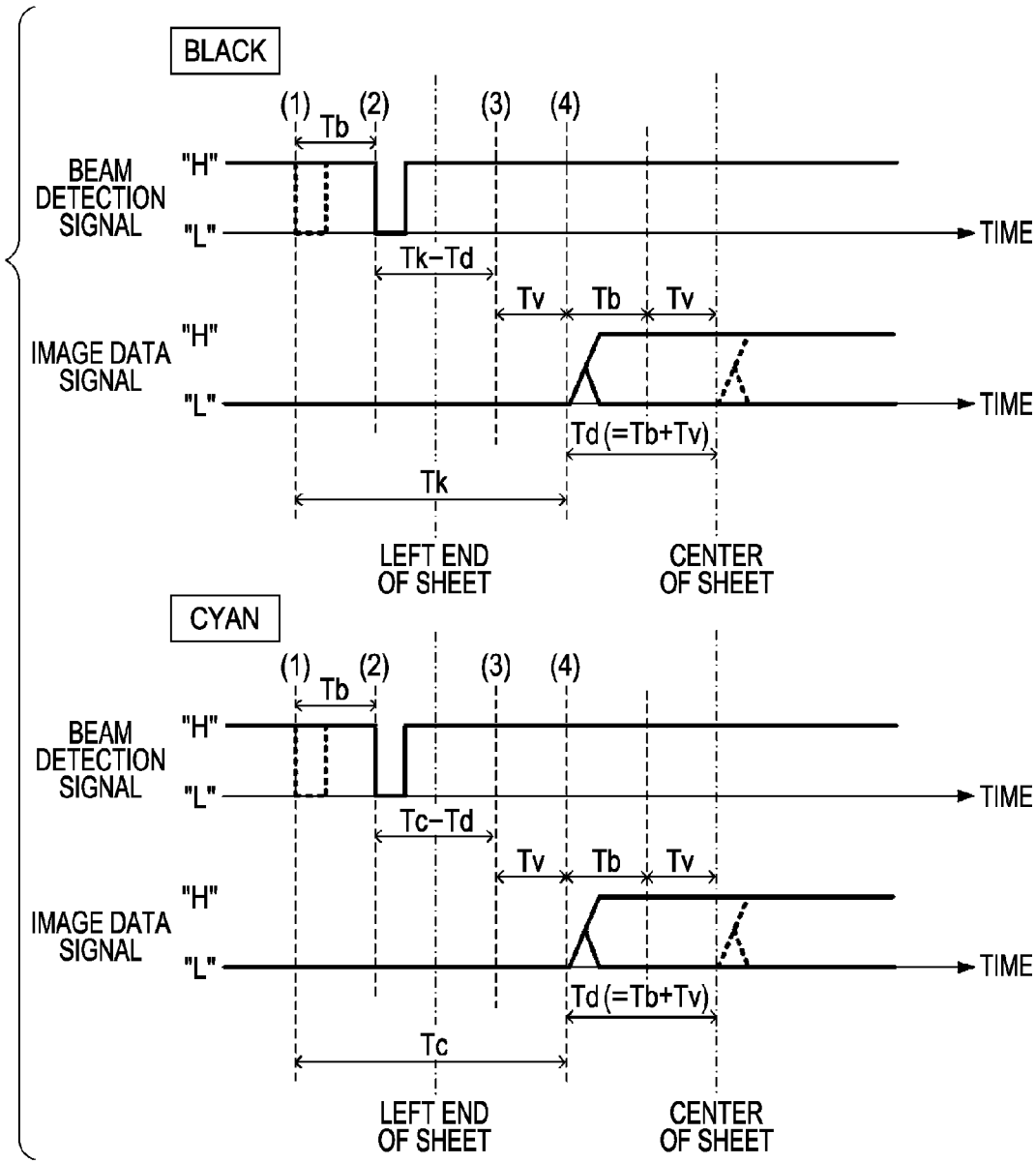
FIG. 15 is a timing chart that illustrates behavior of a laser beam detection signal and an image data signal when there is a transmission delay according to the first embodiment.

FIG. 15 is a timing chart that illustrates behavior of a laser beam detection signal and an image data signal when transmission delay is corrected. The timing chart corresponds to a case in which a process of the flowchart of FIG. 14 is executed.

In the present embodiment, by way of example, the transmission delay time Td in each color unit is the same. In FIG. 15, the time counted from a synchronization detection signal to formation of an electrostatic latent image of black at the center thereof is Tk−Td, and the time counted from a synchronization detection signal to formation of an electrostatic latent image of cyan at the center thereof is Tc−Td. The details of subtraction of Td will be described using arithmetic expressions after the description for the flowchart.

Figure 16:
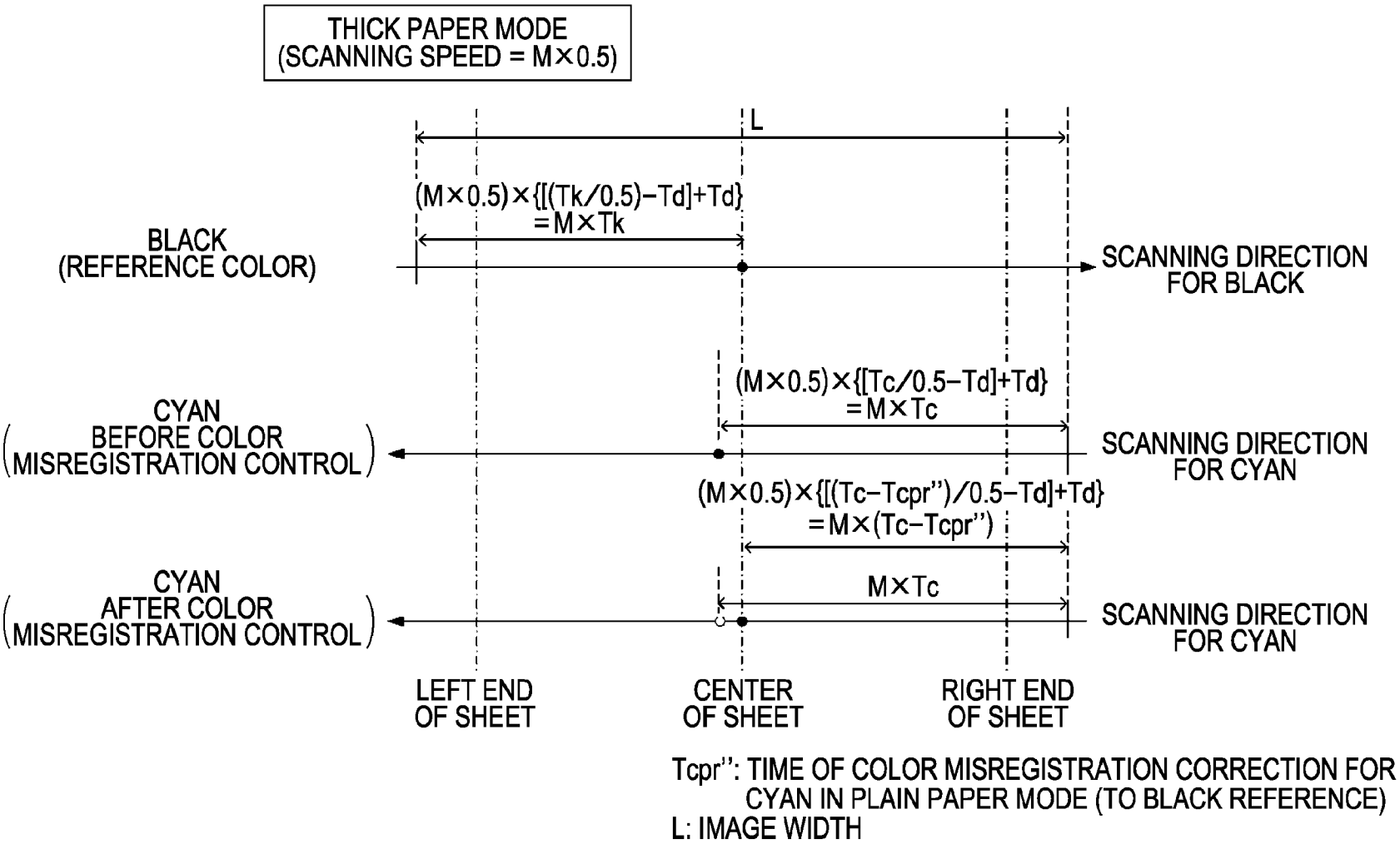
FIG. 16 illustrates correction of color misregistration in a thick-paper mode when the scanning direction for the reference color and the scanning direction for another color are different according to the first embodiment.

FIG. 1 illustrates color misregistration correction in the plain-paper mode when the scanning direction for the reference color and the scanning direction for another color are different. In the following description, image writing based on the timing chart of FIG. 1 or 16 is used when a color misregistration detection pattern is formed illustrated in the flowchart of FIG. 6 and/or when an image other than an image of a color misregistration detection pattern for each color is formed. As previously described with reference to FIG. 15, the transmission delay time Td is subtracted from the time counted from a synchronization detection signal to formation of an electrostatic latent image at the center in each unit before image formation. In this state, when correction control of color misregistration is performed on cyan on the basis of the amount of color misregistration determined by the flowchart of FIG. 6, the time when an electrostatic latent image of cyan is formed is corrected by Tcpr" such that the position at which the cyan electrostatic latent image is formed becomes equal to the position at which an electrostatic latent image of black being the reference color is formed. That is, in step S18032 in FIG. 14, T1 is a value in which Td+Tcpr" is subtracted from T0.

As a result, in the plain-paper mode, $$M\times\{[Tk-Td]+Td\}+M\times\{(Tc-Tcpr''-Td)+Td\}=L \quad (18)$$

$$M\times Tk+M\times(Tc-Tcpr'')=L \quad (19)$$

Accordingly, color misregistration does not occur between black and cyan.

That is, the amount of color misregistration is detected using the color misregistration detection pattern, and Tcpr" is determined such that color misregistration corresponding to the detected amount does not occur.

FIG. 16 illustrates color misregistration correction in the thick-paper mode when the scanning direction for the reference color and the scanning direction for another color are different. In FIG. 16, the scanning speed in the thick-paper mode is M×0.5 and the time of forming an electrostatic latent image is 2 times the time in the plain-paper mode (=1/0.5), as in the case of FIGS. 11 and 13. The position at which an electrostatic latent image of black is formed with reference to the left end of the image width is determined by $$(M\times0.5)\times\{[(Tk/0.5)-Td]+Td\}=M\times Tk \quad (20)$$

The position at which an electrostatic latent image of cyan is formed with reference to the right end of the image width is determined by the following equation (21). In equation (21), image writing timing that enables the delay time to be reduced revised using Tcpr" determined by correction control of color misregistration in the plain-paper mode is set.

$$(M\times0.5)\times\{[(Tc-Tcpr'')/0.5-Id]+Td\}=M\times(Tc-Tcpr'') \quad (21)$$

Here, the correction time Tcpr" when correction control of color misregistration is performed on cyan is the same as the amount of correction calculated by the correction control of color misregistration in the plain-paper mode.

The amount of color misregistration in the thick-paper mode is determined by $$\{L-\text{Equation (20)}\}-\text{Equation (21)}=L-M\times TkM\times(Tc-Tcpr'')=0 \quad (22)$$

Accordingly, in the thick-paper mode, color misregistration does not occur without having to perform correction using the color misregistration detection pattern.

In the present embodiment, by way of example, the scanning speed in the thick-paper mode is 0.5 times the scanning speed in the plain-paper mode (M×0.5). However, the scaling factor is not limited to 0.5 times. Generally, when the scanning speed in the thick-paper mode is 1/m times (m>0) the scanning speed in the plain-paper mode, the position at which an electrostatic latent image of black is formed, the position at which an electrostatic latent image of cyan is formed, and the amount of color misregistration between cyan and black are represented by $$(M/m)\times\{[(Tk\times m)-Td]+Td\}=M\times Tk \quad (23)$$

$$(M/m)\times\{[(Tc-Tcpr'')\times m-Td]+Td\}=M\times(Tc-Tcpr'') \quad (24)$$

$$\{L-\text{Equation (23)}\}-\text{Equation (24)}=0 \quad (25)$$

from a similar thought to equations (20), (21), and (22). Accordingly, when the scanning direction for the reference color and the scanning direction for another color are different, color misregistration in the thick-paper mode between the reference color and another color does not occur. In the present embodiment, the scanning speed of the laser scanner in the thick-paper mode is changed based on the scanning speed in the plain-paper mode. However, a changed subject is not limited to the scanning speed. For example, the scanning speed may be fixed and a picture frequency of the laser scanner in the thick-paper mode may be changed based on the picture frequency in the plain-paper mode. In the present embodiment, by way of example, the scanning speed of the laser scanner in the thick-paper mode is changed based on the scanning speed in the plain-paper mode.

As described above, a color image forming apparatus that is operable in print modes for different scanning speeds and that can perform scanning the reference color and scanning another color in different scanning speeds can perform reliable color misregistration correction. For example, when the transmission delay time from output of a laser beam detection signal from the laser beam generating unit 1001 to input of an image data signal into the laser beam generating unit 1001 is stored in advance and the time when image data is formed in the plain-paper mode is corrected, color misregistration in the thick-paper mode can also be corrected. This obviates the necessity to form a color misregistration detection pattern in the thick-paper mode, and the color printer can reduce color misregistration.

Second Embodiment

A color printer according to a second embodiment will now be described. In the first embodiment, the transmission delay time Td from output of a laser beam detection signal from the laser beam generating unit 1001 to input of an image data signal into the laser beam generating unit 1001 is measured by a measuring device (e.g., an oscilloscope) and stored in the memory 1004 in advance. In contrast, in the second embodiment, correction control of color misregistration (formation of a color misregistration detection pattern) is performed in each of the print modes, and the transmission delay time Td obtained by calculation from the performance of the correction control is stored in the memory 1004. Control executed after the transmission delay time Td is read from the memory 1004 is substantially the same as in the first embodiment.

As previously described with reference to FIG. 12, in a case where the scanning direction for the reference color and the scanning direction for another color are different and there is a transmission delay, when correction control of color misregistration is performed, the time when an electrostatic latent image of cyan is formed is corrected by Tcpr' such that the position at which the cyan electrostatic latent image is formed becomes equal to the position at which an electrostatic latent image of black being the reference color is formed. Here, by way of example, the transmission delay time is the same, irrespective of color. As a result, the amount of correction of color misregistration between cyan and black in the plain-paper mode is represented by $$M\times Tcpr'=2\times(M\times Td)+A \tag{26}$$

Figure 17:
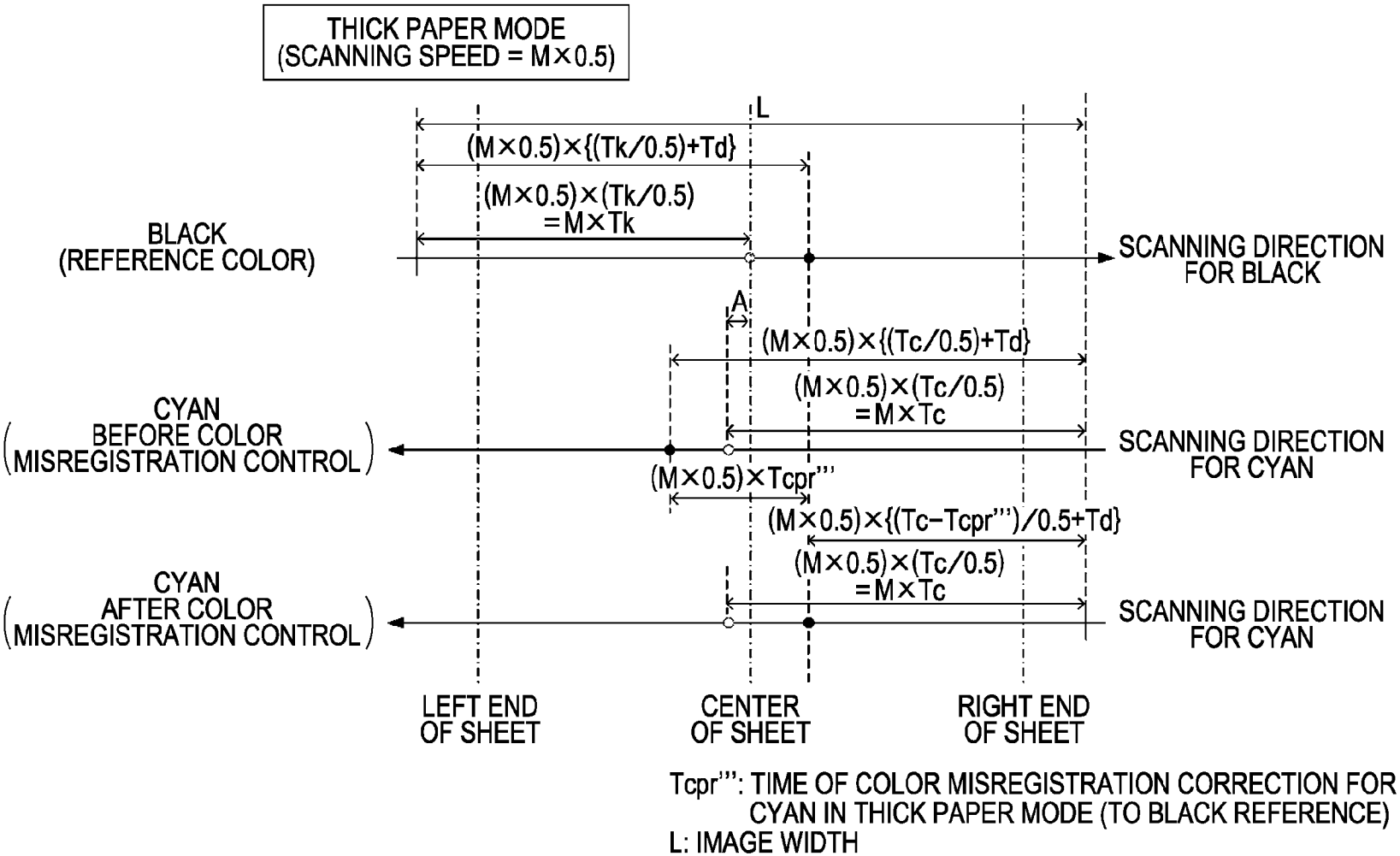
FIG. 17 illustrates correction of color misregistration in the thick-paper mode when the scanning direction for the reference color and the scanning direction for another color are different according to a second embodiment of the present invention.

FIG. 17 illustrates color misregistration correction in the thick–paper mode when the scanning direction for the reference color and the scanning direction for another color are different. M indicates the scanning speed in the plain-paper mode, Tcpr''' indicates the correction time when correction control of color misregistration is performed on cyan in the thick-paper mode, reference letter "A" indicates the amount of color misregistration between cyan and black before correction control of color misregistration is performed on cyan when there is no transmission delay. In FIG. 17, by way of example, the scanning speed in the thick-paper mode is 0.5 times the scanning speed in the plain-paper mode (M×0.5) and the time of forming an electrostatic latent image is 2 times the time in the plain-paper mode (=1/0.5), as in the case of FIGS. 11, 13, and 16.

In a case where there is a transmission delay, when correction control of color misregistration is performed on cyan, the time when an electrostatic latent image of cyan is formed is corrected by Tcpr''' such that the position at which the cyan electrostatic latent image is formed becomes equal to the position at which an electrostatic latent image of black being the reference color is formed. Here, by way of example, the transmission delay time is the same, irrespective of color. As a result, the amount of correction of color misregistration between cyan and black in the thick-paper mode is represented by $$(0.5\times M)\times Tcpr'''=2\times\{(M\times 0.5)\times Td\}+A \tag{27}$$

From equations (26) and (27), the transmission delay time Td is determined by $$Td=Tcpr'-0.5\times Tcpr''' \tag{28}$$

The data control unit 1002 executes the above calculation, and stores the transmission delay time Td in the memory 1004. The time when image data is formed is corrected on the basis of the stored transmission delay time Td in a similar manner to the first embodiment.

In the present embodiment, by way of example, the scanning speed in the thick-paper mode is 0.5 times the scanning speed in the plain-paper mode (M×0.5). However, the scaling factor is not limited to 0.5 times. Generally, when the scanning speed in the thick-paper mode is 1/m times (m>0) the scanning speed in the plain-paper mode, the amount of correction of color misregistration and the transmission delay time Td are represented by $$(M/m)\times Tcpr'''=2\times\{(M/m)\times Td\}+A \tag{29}$$

$$Td=(m\times Tcpr'-Tcpr''')/\{2\times(m-1)\} \tag{30}$$

from a similar thought to equations (27) and (28). Accordingly, the transmission delay time Td can be determined. The determined transmission delay time Td enables image writing timing for correcting positional displacement (the amount of delay color misregistration) between image writing positions caused by transmission delay time occurring in a plurality of modes to be set in at least one of laser beam generating units. This is also applicable to the third to fifth embodiments described below.

As described above, when a color printer that is operable in print modes for different speeds and that can perform scanning for the reference color and scanning for another color in different directions performs correction control of color misregistration in each of the print modes, calculates the transmission delay time from the performance of the correction control and stores it, the necessity of an additional measuring device is obviated. That is, the transmission delay time can be determined more easily, and the color printer can reduce color misregistration with high precision with an inexpensive structure.

Third Embodiment

A color printer according to a third embodiment will now be described. In the first embodiment, the transmission delay time Td from output of a laser beam detection signal from the laser beam generating unit 1001 to input of an image data signal into the laser beam generating unit 1001 is measured by a measuring device (e.g., an oscilloscope) and stored in the memory 1004 in advance. However, the delay time in a transmission path is changed with time by deterioration of an electric device (not shown) or other causes. To address this, in the third embodiment, a transmission delay detecting unit configured to detect the transmission delay time and serving as a delay-amount detecting unit is provided. The result of detection of the amount of delay is stored in the memory 1004, and the stored transmission delay time is read when needed to correct the time when image data is formed.

Figure 18:
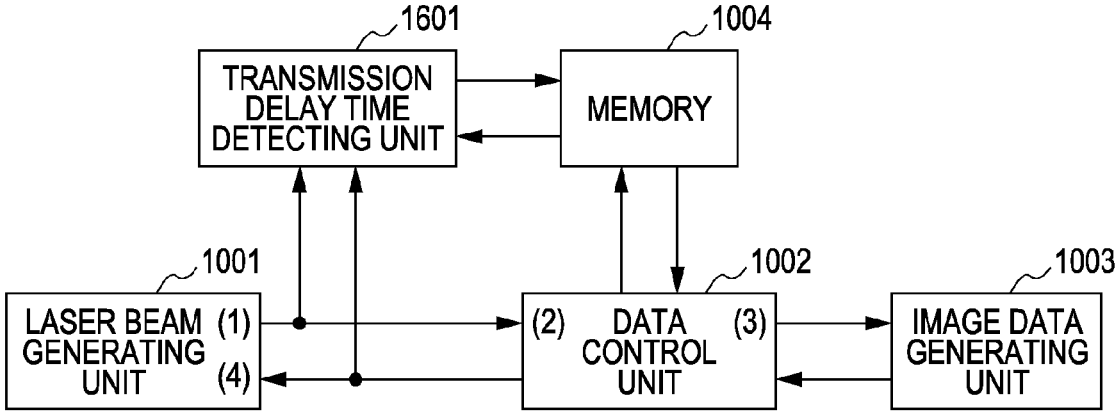
FIG. 18 is a block diagram that illustrates a configuration of a controller that controls recording of an electrostatic latent image of a color printer according to a third embodiment of the present invention.

FIG. 18 illustrates the details of a controller that controls recording of an electrostatic latent image in a color printer according to the present embodiment. The laser beam generating unit 1001, the data control unit 1002, the image-data generating unit 1003, and the memory 1004 have the same structures and perform the same operations as in the first embodiment described with reference to FIG. 5. A transmission delay time detecting unit 1601 is configured to detect the transmission delay time from output of a laser beam detection signal from the laser beam generating unit 1001 and to input of an image data signal into the laser beam generating unit 1001.

The transmission delay time detecting unit 1601 detects the time (1) when the laser beam generating unit 1001 outputs the laser beam detection signal (also referred to as "the time when image data is requested") and the time (4) when the image data signal is input to the laser beam generating unit 1001. Then, the transmission delay time detecting unit 1601 calculates the difference between a predetermined period of time previously stored in the memory 1004 and the time interval between the time (1) and the time (4). The transmission delay time detecting unit 1601 stores the result of the calculation in the memory 1004 as the transmission delay time Td. The data control unit 1002 reads the transmission delay time Td calculated by the transmission delay time detecting unit 1601 from the memory 1004 and corrects the time when image data is generated on the basis of the transmission delay time Td, as in the case of the first embodiment.

As described above, a color image forming apparatus that is operable in print modes for different scanning speeds and that can perform scanning for a reference color and scanning for another color in different scanning directions can correct misregistration of the position at which an electrostatic latent image is formed. That is, the color printer can correct misregistration of the position at which an electrostatic latent image is formed caused by variations in delay time in a transmission path resulting from deterioration in an electric device by having the transmission delay time detecting unit and correcting the time when image data is formed on the basis of the detection. Therefore, the color printer can reduce color misregistration with higher precision with an inexpensive structure.

Fourth Embodiment

In the embodiments described above, on the basis of the transmission delay time from output of a laser beam detection signal from the laser beam generating unit 1001 to input of an image data signal into the laser beam generating unit 1001 and the amount of color misregistration in the plain-paper mode, both the time when image data of the reference color is formed and the time when image data of another color is formed are corrected. However, the present invention is not limited to this correction. If the transmission delay time from output of a laser beam detection signal to input of an image data signal for the reference color is the same as in colors other than the reference color, only the time when image data of the reference color may be corrected. The details are described below. In the description below, by way of example, the transmission delay time for the reference color and the transmission delay time for a color other than the reference color (e.g., cyan) are the common transmission delay time Td.

In FIG. 1, only formation of an image of the reference color is subjected to subtraction of 2×Td, which is the sum of the transmission delay time for the reference color and that for a color other than the reference color, from the time counted from a synchronization detection signal to formation of an electrostatic latent image performed by each color unit at the center thereof. That is, for the reference color, in step S18032 in the flowchart of FIG. 14, T1=T0−2Td−TcprA is used, whereas, for a color other than the reference color, T1=T0−TcprA is used. TcprA is the correction time when correction control of color misregistration is performed on cyan in the plain-paper mode in a case where T1=T0−2Td−TcprA is used for the reference color and T1=T0−TcprA is used for a color other than the reference color in step S18032 in the flowchart of FIG. 14. In this case, the time when an electrostatic latent image of cyan is formed is corrected by TcprA such that the position at which the cyan electrostatic latent image is formed becomes equal to the position at which an electrostatic latent image of black being the reference color is formed. As a result, the position at which an electrostatic latent image of black is formed in the plain-paper mode with reference to the left end of the image width is determined by $$M\times\{[Tk-2\times Td]+Td\} \tag{31}$$

The position at which an electrostatic latent image of cyan is formed in the plain-paper mode with reference to the right end of the image width is determined by $$M\times\{(Tc-TcprA)+Td\} \tag{32}$$

Accordingly, color misregistration does not occur between black and cyan in the plain-paper mode under the following conditions for the position at which the black electrostatic latent image is formed and the position at which the cyan electrostatic latent image is formed:

$$M\times\{[Tk-2\times Td]+Td\}+M\times\{(Tc-TcprA)+Td\}=L \tag{33}$$

$$M\times Tk+M\times(Tc-TcprA)=L \tag{34}$$

where TcprA is the correction time when correction control of color misregistration is performed on cyan in the plain-paper mode.

In FIG. 16, the position at which an electrostatic latent image of black is formed in the thick-paper mode with reference to the left end of the image width is determined by $$(M\times 0.5)\times\{[(Tk/0.5)-2\times Id]+Td\} \tag{35}$$

The position at which an electrostatic latent image of cyan is formed in the thick-paper mode with reference to the right end of the image width is determined by $$(M\times 0.5)\times\{(Tc-TcprA)/0.5+Td\} \tag{36}$$

Here, TcprA is the same as the correction time when correction control of color misregistration is performed on cyan in the plain-paper mode. The amount of color misregistration between black and cyan in the thick-paper mode is determined by $$\begin{aligned}
&\{L-\text{Equation (35)}\}-\text{Equation (36)} = \\
&\quad L-(M\times 0.5)\times\{[(Tk/0.5)-2\times Td]+Td\}- \\
&\quad (M\times 0.5)\times\{(Tc-TcprA)/0.5+Td\} = \\
&\quad L-M\times(Tk-0.5\times Td)-M\times(Tc-TcprA+0.5\times Td) = \\
&\quad L-M\times(Tk+Tc-TcprA) \\
&\text{From equation (34),}\ =\{M\times Tk+M\times(Tc-TcprA)\}- \\
&\quad M\times(Tk+Tc-TcprA)=0
\end{aligned}$$

Accordingly, also in the thick-paper mode, color misregistration does not occur.

In the foregoing description, only the time when image data of the reference color is formed is corrected. However, only the time when image data of a color (measured color) other than the reference color may be corrected. That is, in step S18032 in the flowchart of FIG. 14, for the reference color, T1=T0−TcprB is used, whereas, for a color other than the reference color, T1=T0−2Td−TcprB is used. TcprB is the correction time when correction control of color misregistration is performed on cyan in the plain-paper mode in a case where T1=T0−TcprB is used for the reference color and T1=T0−2Td−TcprB is used for a color other than the reference color in step S18032 in the flowchart of FIG. 14. The details are described below. In the description below, by way of example, the transmission delay time for the reference color and the transmission delay time for a color other than the reference color (e.g., cyan) are the common transmission delay time Td.

In FIG. 1, only formation of an image of a color other than the reference color is subjected to subtraction of 2×Td, which is the sum of the transmission delay time for the reference color and the scanning direction a color other than the reference color, from the time counted from a synchronization detection signal to formation of an electrostatic latent image performed by each color unit at the center thereof. In this case, the time when an electrostatic latent image of cyan is formed is corrected by TcprB such that the position at which the cyan electrostatic latent image is formed becomes equal to the position at which an electrostatic latent image of black being the reference color is formed. As a result, the position at which an electrostatic latent image of black is formed in the plain-paper mode with reference to the left end of the image width is determined by $$M\times(Tk+Td) \tag{37}$$

The position at which an electrostatic latent image of cyan is formed in the plain-paper mode with reference to the right end of the image width is determined by $$M\times\{[(Tc-2\times Td)-TcprB]+Td\} \tag{38}$$

Accordingly, color misregistration does not occur between black and cyan in the plain-paper mode under the following conditions for the position at which the black electrostatic latent image is formed and the position at which the cyan electrostatic latent image is formed:

$$M\times(Tk+Td)+M\times\{[(Tc-2\times Td)-TcprB]+Td\}=L \tag{39}$$

$$(M\times Tk)+M\times(Tc-TcprB)=L \tag{40}$$

where TcprB is the correction time when correction control of color misregistration is performed on cyan in the plain-paper mode.

In FIG. 16, the position at which an electrostatic latent image of black is formed in the thick-paper mode with reference to the left end of the image width is determined by $$(M\times 0.5)\times\{(Tk/0.5)+Td\} \tag{41}$$

The position at which an electrostatic latent image of cyan is formed in the thick-paper mode with reference to the right end of the image width is determined by $$(M\times 0.5)\times\{[(Tc-TcprB)/0.5-2\times Td]+Td\} \tag{42}$$

Here, TcprB is the same as the correction time when correction control of color misregistration is performed on cyan in the plain-paper mode. The amount of color misregistration between black and cyan in the thick-paper mode is determined by $$\begin{aligned}\{L-\text{Equation (41)}\}-\text{Equation (42)} &= L-(M\times 0.5)\times\{(Tk/0.5)+Td\}-\\ &(M\times 0.5)\times\{[(Tc-TcprB)/0.5-2\times Td]+Td\}=\\ &L-M\times(Tk-0.5\times Td)-M\times(Tc-TcprB-0.5\times Td)=\\ &L-M\times(Tk+Tc-TcprB)\\ \text{From equation (40),}\ &=(M\times Tk)+M\times(Tc-TcprB)-\\ &M\times(Tk+Tc-TcprB)=0\end{aligned}$$

Accordingly, also in the thick-paper mode, color misregistration does not occur.

As described above, in the fourth embodiment, the transmission delay time is considered for image writing timing for only a reference color or that for only a measured color. However, how to distribute image writing timing between a scan in a first optical scanning direction for a reference color and a scan in a second optical scanning direction opposite to the first optical direction for a measured color is not limited to the present embodiment. Various forms may be made as long as they can reduce the difference in operation modes, the difference being defined by an image writing position performed by a scan in a first scanning direction corresponding to the length of the delay time and an image writing position performed by a scan in a second scanning direction for the length of the delay time. The description of the first and fourth embodiments will enable a person skilled in the art to adequately understand such various forms.

Fifth Embodiment

In the foregoing embodiments, for each of the plain-paper mode and the thick-paper mode, the time when image data is formed is corrected in accordance with the transmission delay time from output of a laser beam detection signal from the laser beam generating unit 1001 to input of an image data signal into the laser beam generating unit 1001. However, the present invention is not limited to those embodiments. The time when image data is formed may be corrected in accordance with the transmission delay time in only one of the plain-paper mode and the thick-paper mode.

In the embodiments described above, the time when image data is generated in the thick-paper mode is corrected based on the transmission delay time from output of a laser beam detection signal from the laser beam generating unit to input of an image data signal into the laser beam generating unit and the correction time in the plain-paper mode. However, the time when image data is generated in the thick-paper mode may be corrected based on the transmission delay time from output of a laser beam detection signal from the laser beam generating unit to input of an image data signal into the laser beam generating unit and the scanning speed in the thick-paper mode. The details are described below.

From equation (12), the correction time Tcpr' of color misregistration calculated by correction control of color misregistration in the plain-paper mode illustrated in FIG. 12 is represented by $$Tcpr'=Tc+Tk-L/M+2\times Td \tag{43}$$

In FIG. 13, where the scanning speed in the thick-paper mode is 0.5 times the scanning speed in the plain-paper mode, the correction time Tcprt of color misregistration for cyan for enabling the position at which an electrostatic latent image of black, which is the reference color, is formed to be equal to the position at which an electrostatic latent image of cyan is formed is represented by $$Tcprt=Tc+Tk-L/M+Td \tag{44}$$

from a similar thought to equation (12). If the correction time Tcpr' of color misregistration calculated by correction control of color misregistration in the plain-paper mode is used, the amount of correction is different by Td, and this causes color misregistration, as described above in the related technique. Generally, when the scanning speed in the thick-paper mode is 1/m times (m>0) the scanning speed in the plain-paper mode, the correction time Tcprt' of color misregistration for cyan for enabling the position at which an electrostatic latent image of black, which is the reference color, is formed to be equal to the position at which an electrostatic latent image of cyan is formed is represented by $$Tcprt'=Tc+Tk-L/M+(2/m)\times Td(m>0) \tag{45}$$

The correction amount of the time when image data is formed in the thick-paper mode can be represented by $$(2/m)\times Td(m>0) \tag{46}$$

For example, the correction amount of the time when image data is formed when m=2 (0.5 times the scanning speed in the plain-paper mode) can be represented by Td, and the correction amount of the time when image data is formed when m=4 (0.25 times the scanning speed in the plain-paper mode) can be represented by 0.5×Td.

More specific description of the present embodiment will be provided below.

Figure 20:
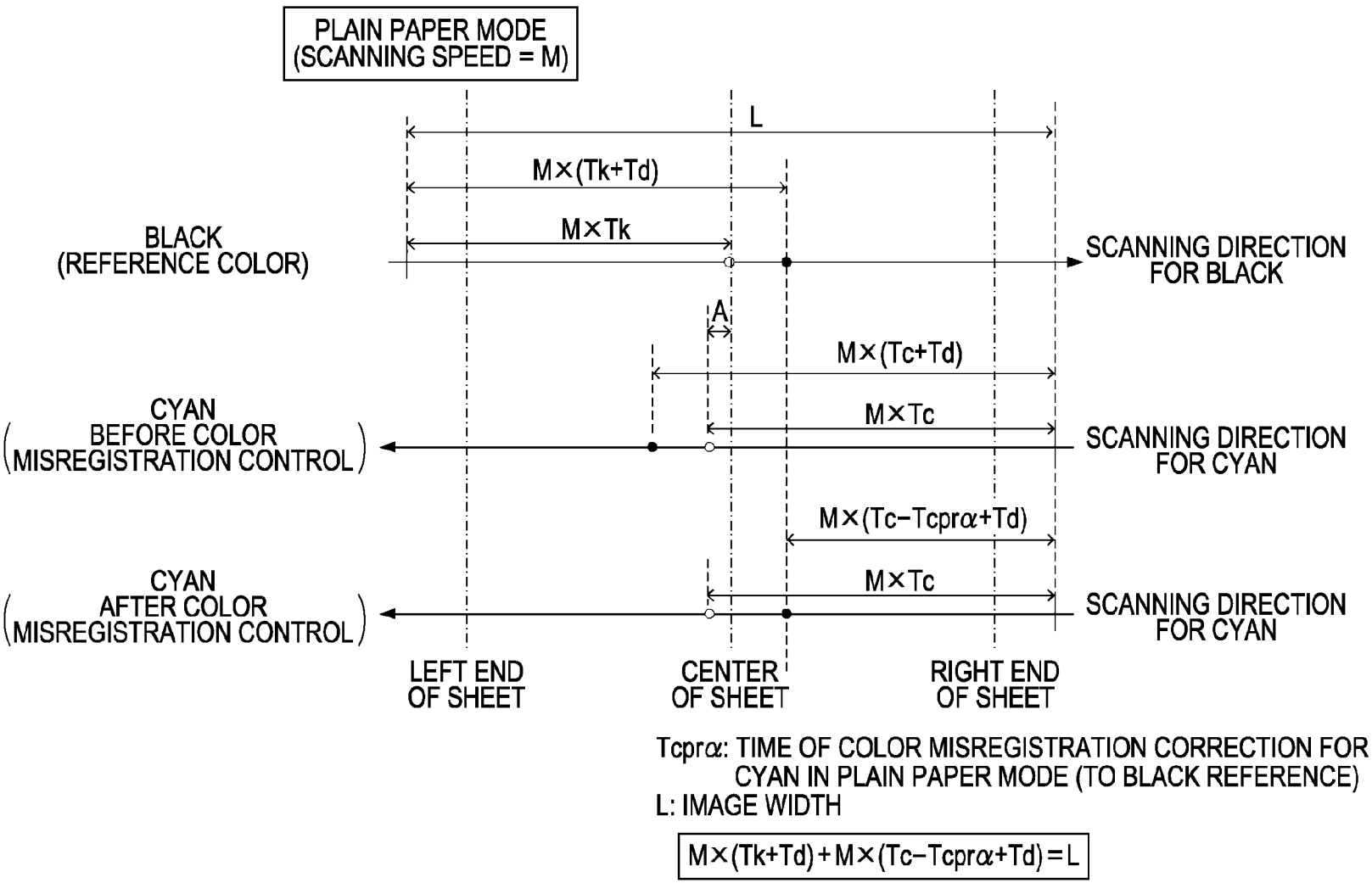
FIG. 20 illustrates correction of color misregistration in a plain-paper mode when the scanning direction for the reference color and the scanning direction for another color are different according to a fifth embodiment.

FIG. 20 illustrates correction of color misregistration in the plain-paper mode when the scanning direction for the reference color and the scanning direction for another color are different. M indicates the scanning speed in the plain-paper mode. Tcprα indicates the correction time when correction control of color misregistration is performed on cyan in the plain-paper mode. The correction time Tcprα can be detected by formation of a color misregistration detection pattern. In the present embodiment, by way of example, the time when image data is formed is corrected in accordance with the transmission delay time for only a color other than the reference color in the thick-paper mode.

Reference letter "A" indicates the amount of color misregistration between cyan and black before correction control of color misregistration is performed on cyan when there is no transmission delay. When there is transmission delay, as in the case of FIGS. 10 and 12, forming an image lags by the length of the transmission delay time. As a result, the position at which an electrostatic latent image is formed is displaced downstream in the main scanning direction. In this state, when correction control of color misregistration is performed on cyan, the time when an electrostatic latent image of cyan is formed is corrected by Tcprα such that the position at which the cyan electrostatic latent image is formed becomes equal to the position at which an electrostatic latent image of black being the reference color is formed.

As a result, in the plain-paper mode, color misregistration does not occur between black and cyan under the following conditions:

$$M\times(Tk+Td)+M\times(Tc-Tcpr\alpha+Td)=L \quad (47)$$

$$L-M\times(Tk+Td)=M\times(Tc-Tcpr\alpha+Td) \quad (48)$$

where L indicates the width of an image formed in one scan.

Figure 21:
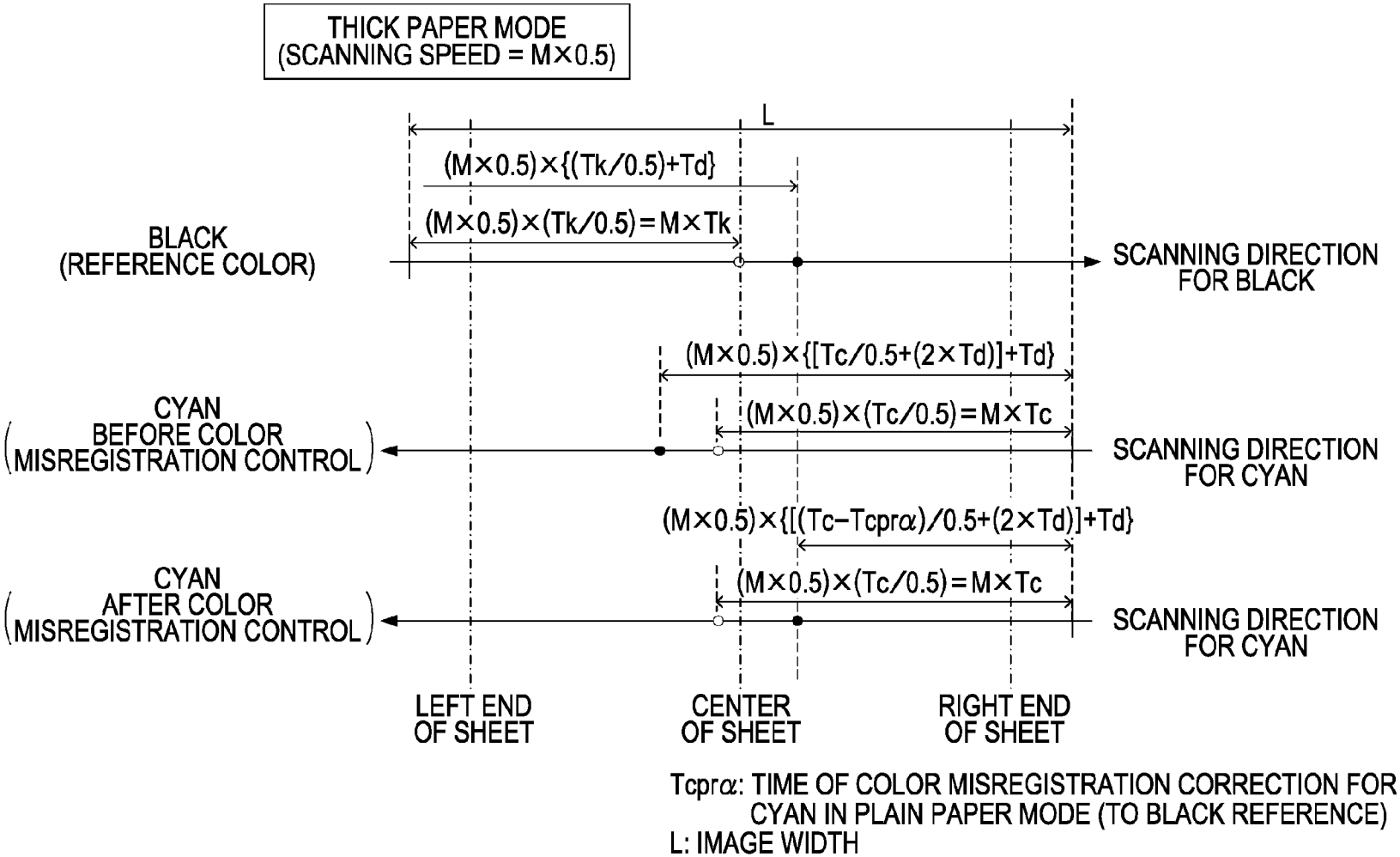
FIG. 21 illustrates correction of color misregistration in a thick-paper mode when the scanning direction for the reference color and the scanning direction for another color are different according to the fifth embodiment.

FIG. 21 illustrates color misregistration correction in the thick-paper mode when the scanning direction for the reference color and the scanning direction for another color are different. In FIG. 21, the scanning speed in the thick-paper mode is 0.5 times the scanning speed in the plain-paper mode (M×0.5) and the time of forming an electrostatic latent image is 2 times (=1/0.5) the time in the plain-paper mode, as in the case of FIGS. 11, 13, and 16.

In step S18032 in the flowchart of FIG. 14, the transmission delay time Td is subtracted from the time count. In the present embodiment, 2×Td is added and the result is stored as a count time T1. In the present embodiment, steps other than step S18032 are performed in the same manner as in FIG. 14, so the description thereof is not repeated here. The value of 2×Td means the sum of the transmission delay time for the reference color and that for another color.

The position at which an electrostatic latent image of black is formed with reference to the left end of the image width is determined by $$(M\times0.5)\times\{(Tk/0.5)+Td\} \quad (49)$$

$$=M\times Tk+0.5\times M\times Td \quad (50)$$

The position at which an electrostatic latent image of cyan is formed with reference to the right end of the image width is determined by $$(M\times0.5)\times\{[(Tc-Tcpr\alpha)/0.5)+(2\times Td)]+Td\} \quad (51)$$

$$=M\times(Tc-Tcpr\alpha)+1.5\times M\times Td \quad (52)$$

Here, the amount of correction Tcprα when correction control of color misregistration is performed on cyan is the same as the amount of correction calculated by the correction control of color misregistration in the plain-paper mode.

The amount of color misregistration in the thick-paper mode is determined by $$\{L-\text{Equation (50)}\}-\text{Equation (52)}=0 \quad (53)$$

Accordingly, in the thick-paper mode, color misregistration does not occur without having to perform correction using the color misregistration detection pattern.

In the present embodiment, by way of example, the scanning speed in the thick-paper mode is 0.5 times the scanning speed in the plain-paper mode (M×0.5). However, the scaling factor is not limited to 0.5 times. Generally, when the scanning speed in the thick-paper mode is 1/m times (m>0) the scanning speed in the plain-paper mode, the position at which an electrostatic latent image of black is formed, the position at which an electrostatic latent image of cyan is formed, and the amount of color misregistration between cyan and black are represented by $$(M/m)\times\{(Tk\times m)+Id\}=M\times Tk+M/m\times Td \quad (54)$$

$$(M/m)\times\{[(Tc-Tcpr\alpha)\times m+(2\times Id)]+Td\}=M\times(Tc-Tcpr\alpha)+M/m\times3\times Td \quad (55)$$

$$\{L-\text{Equation (54)}\}-\text{Equation (55)}=0 \quad (56)$$

from a similar thought to equations (49), (51), and (53). Accordingly, when the scanning direction for the reference color and the scanning direction for another color are different, color misregistration in the thick-paper mode between the reference color and another color does not occur.

In the fifth embodiment, for a color other than the reference color (measured color) in the thick-paper mode, its image writing timing is set such that the amount of delay color misregistration is reduced in consideration of the transmission delay. However, the present invention is not limited to this embodiment. For example, in the thick-paper mode, for both the reference color and another color, the image writing timing based on the transmission delay may be set. That is, a technique described in the fourth embodiment is applied to the fifth embodiment. A person skilled in the art will adequately understand this from the description of the first, fourth, and fifth embodiments.

Various forms for setting an image writing timing in consideration of what the amount of delay color misregistration in what mode to reduce the amount of delay color misregistration may be made as long as the amount of delay color misregistration can be reduced. The description of the first, fourth, and fifth embodiments will enable a person skilled in the art to adequately understand such various forms.

Sixth Embodiment

In the foregoing embodiments, the transmission delay times in different color units from output of a laser beam detection signal from the laser beam generating units 1001 to input of an image data signal into the laser beam generating units 1001 are the same. However, the present invention is not limited to the embodiments. When the transmission delay times in different color units from output of a laser beam detection signal from the laser beam generating units 1001 to input of an image data signal into the laser beam generating units 1001 are different, the image writing timing may be corrected so as to support the transmission delay time for each color. The details will be described below.

Figure 22:
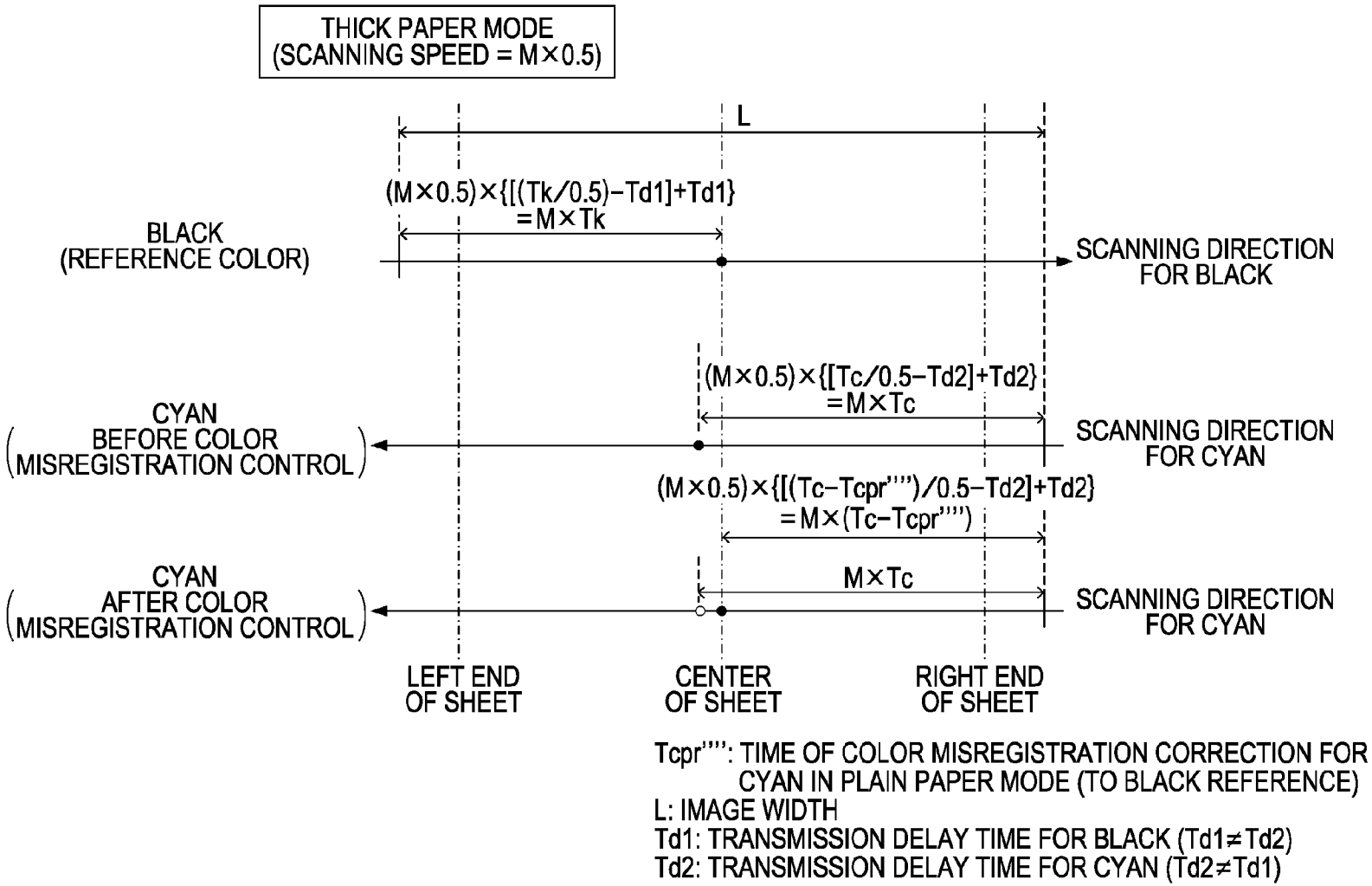
FIG. 22 illustrates correction of color misregistration in a thick-paper mode when the scanning direction for the reference color and the scanning direction for another color are different according to a sixth embodiment.

FIG. 22 illustrates color misregistration correction in the thick-paper mode when the scanning direction for the reference color and the scanning direction for another color are different and the transmission delay times in different color units from output of a laser beam detection signal from the laser beam generating units 1001 to input of an image data signal into the laser beam generating units 1001 are different. In FIG. 22, the scanning speed in the thick-paper mode is 0.5 times the scanning speed in the plain-paper mode (M×0.5) and the time of forming an electrostatic latent image is 2 times (=1/0.5) the time in the plain-paper mode, as in the case of FIGS. 11, 13, and 16. In the present embodiment, the transmission delay time from output of a laser beam detection signal from the laser beam generating units 1001 for black, which is the reference color, to input of an image data signal into the laser beam generating units 1001 is defined as Td1. The transmission delay time from output of a laser beam detection signal from the laser beam generating units 1001 for cyan to input of an image data signal into the laser beam generating units 1001 is defined as Td2 (≠Td1).

In accordance with the flowchart of FIG. 14, for black, the data control unit 1002 subtracts the transmission delay time Td1 from the time count counted from the synchronization signal to formation of an electrostatic latent image in each color unit. For cyan, the data control unit 1002 subtracts the transmission delay time Td2 from the time count counted from the synchronization signal to formation of an electrostatic latent image in each color unit.

The position at which an electrostatic latent image of black is formed with reference to the left end of the image width is determined by $$(M\times 0.5)\times\{[(Tk/0.5)-Td1]+Td1\} \tag{57}$$

$$=M\times Tk \tag{58}$$

The position at which an electrostatic latent image of cyan is formed with reference to the right end of the image width is determined by $$(M\times 0.5)\times\{[(Tc-Tcpr'''')/0.5)-Td2]+Td2\} \tag{59}$$

$$=M\times(Tc-Tcpr'''') \tag{60}$$

Here, the amount of correction Tcpr'''' when correction control of color misregistration is performed on cyan is the same as the amount of correction calculated by the correction control of color misregistration in the plain-paper mode.

From a similar thought to the first embodiment, the amount of color misregistration between black and cyan in the thick-paper mode is determined by $$\{L-\text{Equation (58)}\}-\text{Equation (60)}=L-M\times Tk-M\times(Tc-Tcpr'''')=0 \tag{61}$$

Accordingly, in the thick-paper mode, color misregistration does not occur without having to perform correction using the color misregistration detection pattern.

In the present embodiment, by way of example, the scanning speed in the thick-paper mode is 0.5 times the scanning speed in the plain-paper mode (M×0.5). However, the scaling factor is not limited to 0.5 times. Generally, when the scanning speed in the thick-paper mode is 1/m times (m>0) the scanning speed in the plain-paper mode, the position at which an electrostatic latent image of black is formed, the position at which an electrostatic latent image of cyan is formed, and the amount of color misregistration between cyan and black are represented by $$(M/m)\times\{[(Tk\times m)-Td]+Id\}=M\times Tk \tag{62}$$

$$(M/m)\times\{[(Tc-Tcpr'''')\times m-Td]+Id\}=M\times(Tc-Tcpr'''') \tag{63}$$

$$\{L-\text{Equation (62)}\}-\text{Equation (63)}=0 \tag{64}$$

from a similar thought to equations (57), (59), and (61). Accordingly, when the scanning direction for the reference color and the scanning direction for another color are different, color misregistration in the thick-paper mode between the reference color and another color does not occur.

In the present embodiment, the scanning speed of the laser scanner in the thick-paper mode is changed based on the scanning speed in the plain-paper mode. However, a changed subject is not limited to the scanning speed. For example, the scanning speed may be fixed and a picture frequency of the laser scanner in the thick-paper mode may be changed based on the picture frequency in the plain-paper mode. In the present embodiment, by way of example, the scanning speed of the laser scanner in the thick-paper mode is changed based on the scanning speed in the plain-paper mode.

As described above, the present invention is also applicable to a case where different transmission delay times occur for different colors. In the second embodiment, the transmission delay time in each color is shared. However, the second embodiment is performed even when the transmission delay times are different. That is, Td in equations (26) and (27) described in the second embodiment is separated into Td1 and Td2, and the value of each of Td1 and Td2 can be determined by making the image forming apparatus calculate linear simultaneous equations. The determined values of Td1 and Td2 are stored in the memory 1004, as described in the second embodiment, and image writing timing that enables the difference between the amounts of delay color misregistration occurring in operation modes to be reduced is achieved based on the stored values of Td1 and Td2.

Other Embodiments

The embodiments of the present invention are described above. The present invention is also applicable to a system including a plurality of devices and to an apparatus including a single device.

The image bearing unit in the first to sixth embodiments is a photosensitive drum. However, a belt photosensitive member driven by a driving roller can also be used.

In the first to sixth embodiments, an image forming operation is performed in two kinds of print modes, i.e., the plain-paper mode and the thick-paper mode. However, the image forming operation may be performed in other modes as long as they use different scanning speeds.

In the first to sixth embodiments, the scanning speed in the thick-paper mode has a lower frequency than that in the plain-paper mode. However, other different scanning speeds may be used. For example, the scanning speed in the thick-paper mode is higher than that in the plain-paper mode.

The transmission delay time may be the same, irrespective of color (a first color, second color, third color, . . . ) or may be different in each color. The reference color for correction control of color misregistration may be a color other than black.

The color printer is described as one example of an image forming apparatus in the first to sixth embodiments. However, the present invention is not limited to the color printer. For example, any other electrophotgraphic image forming apparatuses, such as a color copier, in particular, an image forming apparatus that has a plurality of image forming units can also be used.

The present invention can also be achieved by supplying a control program that performs functions of at least one of the foregoing embodiments from directly or remotely to an image forming apparatus and causing the image forming apparatus to read and execute the supplied program. Therefore, program code itself installable in a computer to enable the computer to perform the functional processing of an aspect of the present invention can also be included in the technical scope of the present invention.

In this case, the program can have any form, such as object code, a program executable by an interpreter, and script data suppliable to an operating system (OS), as long as it has the functions of the program.

Examples of a storage medium for supplying a control program include a floppy disk, a hard disk, an optical disk, a magneto-optical disk (MO), a compact-disk read-only memory (CD-ROM), a compact disk recordable (CD-R), a CD-Rewritable (CD-RW), magnetic tape, a nonvolatile memory card, a ROM, and a digital versatile disk (DVD), such as a DVD-ROM and a DVD-R.

One example of a method for supplying a program is to cause a user to access a website on the Internet using a browser of a client personal computer and to download a program itself or a file further including an automatic installer into a storage medium (e.g., a hard disk). Program code constituting a program according to an aspect of the present invention may be divided into a plurality of files and each file may be downloaded from different websites. A world wide web (WWW) server causing a plurality of users to download a program for executing the functional processing of an aspect of the present invention by a computer is also included in the scope of the present invention. A program according to an aspect of the present invention may be distributed to users through storage media, such as CD-ROMs, that store its encrypted program. In this case, a user who satisfies a predetermined condition can download information regarding a decryption key from a website over the Internet, and the encrypted program can be executed using the key information and installed in a computer.

Performing actual processing in part or in entirety by an operating system (OS) running on a computer in accordance with instructions of a program can realize the functions of at least one of the embodiments described above.

Additionally, performing actual processing in part or in entirety on the basis of a program written on a memory included in a function expansion unit inserted into a personal computer by a data control unit incorporated in the function expansion unit can also be included in the scope of the present invention.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

What is claimed is:

1. A color image forming apparatus comprising:

a plurality of laser beam generating units corresponding to a plurality of colors, each of the laser beam generating units being configured to emit a laser beam based on image data output from an image data generating unit;

a data control unit configured to transmit the image data from the image data generating unit to the plurality of laser beam generating units according to a synchronization signal corresponding to each of the laser beam generating units for synchronizing image writing timing in a main scanning direction in image formation;

a plurality of photosensitive members configured to have respective electrostatic latent images formed thereon by optical scanning performed by the plurality of laser beam generating units; and a detecting unit configured to read an image of a color misregistration detection pattern for each color formed based on irradiation with a laser beam from the plurality of laser beam generating units and detect an amount of color misregistration, the amount of color misregistration being a relative positional displacement between the colors, wherein the color image forming apparatus is operable in a plurality of operation modes including a first operation mode in which an optical scanning speed is a first scanning speed and a second operation mode in which the optical scanning speed is a second scanning speed different from the first scanning speed, wherein the plurality of laser beam generating units perform scanning in a first scanning direction on a first color and scanning in a second scanning direction on a second color, the first scanning direction being different from the second scanning direction, wherein a delay time due to a delay in transmitting, a signal occurs during a time period from the time when the synchronization signal corresponding to each of the laser beam generating units is output, to the time when the plurality of laser beam generating units receives the image data transmitted by the data control unit, and wherein, in the first and second operation modes, at least one of the plurality of laser beam generating units emits a laser beam with image writing timing for enabling influence of the delay time to be reduced.

2. The color image forming apparatus according to claim 1,

Wherein, in one of the first operation mode and the second operation mode, the detecting unit detects the amount of color misregistration, which is the relative positional displacement between the colors, based on reading of the image of the color misregistration detection pattern performed by irradiation with the laser beam with the image writing timing for enabling the delay time to be reduced, and wherein, in the other of the first operation mode and the second operation mode, based on the image writing timing for enabling the delay time to be reduced and the amount of color misregistration detected by the detecting unit, at least one of the plurality of laser beam generating units emits a laser beam.

3. The color image forming apparatus according to claim 1, further comprising:

a determining unit configured to determine image writing timing for enabling influence of the delay time to be reduced at which at least one of the plurality of laser beam generating units emits a laser beam based on an amount of color misregistration detected by reading of the image of the color misregistration detection pattern formed in the first operation mode and an amount of color misregistration detected by reading of the image of the color misregistration detection pattern formed in the second operation mode.

4. The color image forming apparatus according to claim 1, further comprising:

a delay-time detecting unit configured to detect the delay time and store the detected delay time in a storing unit.

5. The color image forming apparatus according to claim 1, wherein the delay time is different according to a color.

6. The color image forming apparatus according to claim 1, wherein the first scanning direction is opposite to the second scanning direction.

* * * * *